US011207724B2

(12) United States Patent
Marchadour

(10) Patent No.: US 11,207,724 B2
(45) Date of Patent: Dec. 28, 2021

(54) ELECTRONIC CAM-TYPE CAN SEAMER

(71) Applicant: TREMARK, Quimper (FR)

(72) Inventor: Jean-Charles Marchadour, Pont l'Abbe (FR)

(73) Assignee: TREMARK, Quimper (FR)

( * ) Notice: Subject to any disclaimer, the term of this patent is extended or adjusted under 35 U.S.C. 154(b) by 294 days.

(21) Appl. No.: 16/320,310

(22) PCT Filed: Jul. 4, 2017

(86) PCT No.: PCT/EP2017/066699
§ 371 (c)(1),
(2) Date: Jan. 24, 2019

(87) PCT Pub. No.: WO2018/019528
PCT Pub. Date: Feb. 1, 2018

(65) Prior Publication Data

US 2019/0247910 A1 Aug. 15, 2019

(30) Foreign Application Priority Data

Jul. 25, 2016 (FR) ..... 16 57133

(51) Int. Cl.
*B21D 51/26* (2006.01)
*B21D 51/32* (2006.01)
*B65D 17/00* (2006.01)

(52) U.S. Cl.
CPC ..... *B21D 51/32* (2013.01); *B21D 51/2623* (2013.01); *B21D 51/2653* (2013.01); *B65D 17/08* (2013.01)

(58) Field of Classification Search
CPC ..... B21D 51/26; B21D 51/2661; B21D 51/2653; B21D 51/2615; B21D 51/2623; B21D 51/32; B65D 17/08
USPC ..... 413/6, 31
See application file for complete search history.

(56) References Cited

U.S. PATENT DOCUMENTS 4,152,997 A * 5/1979 Webster ..... B21D 51/2653 413/29
6,442,988 B1 * 9/2002 Hamstra ..... B21D 22/16 72/100
2009/0151863 A1 * 6/2009 Teramoto ..... H01M 50/56 156/245

(Continued)

FOREIGN PATENT DOCUMENTS

EP 0 828 663 B1 12/1999
EP 2 197 605 B1 5/2011

OTHER PUBLICATIONS

International Search Report for PCT/EP2017/066699 dated Sep. 11, 2017 [PCT/ISA/210].

*Primary Examiner* — Jimmy T Nguyen
(74) *Attorney, Agent, or Firm* — Sughrue Mion, PLLC

(57) ABSTRACT

A crimping unit (1) having a first plate (10); a first lever (50) equipped with a winding wheel (54), a second lever (60) equipped with a crushing wheel (64), a winding actuator connected to the first lever (50), and a crushing actuator connected to the second lever (60). The winding actuator and the crushing actuator are governed by an electronic control unit (7) to vary the distance between the winding wheel (54) and/or the crushing wheel (65) of the first axis according to the angular position of the first plate (10) around the first axis.

10 Claims, 24 Drawing Sheets

IX - IX

(56) References Cited

U.S. PATENT DOCUMENTS

| | | | | |
|---|---|---|---|---|
| 2009/0200321 | A1* | 8/2009 | Oohori | B21D 51/32<br>220/619 |
| 2013/0108399 | A1* | 5/2013 | Aldred | B21D 51/2653<br>413/6 |

* cited by examiner

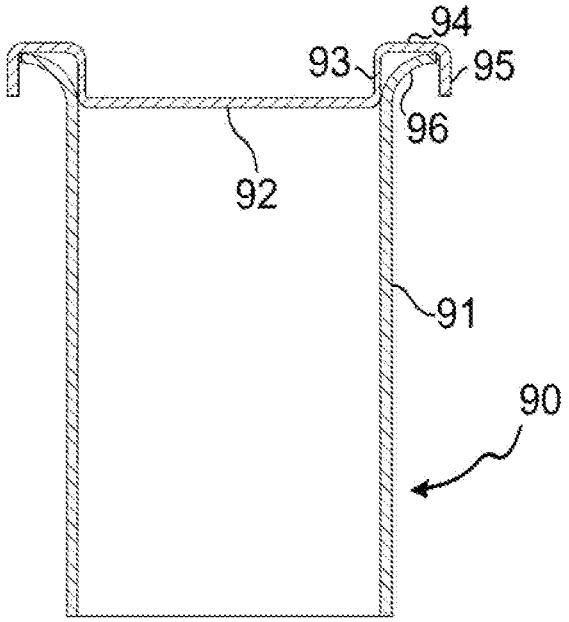
Fig. 1
Prior art
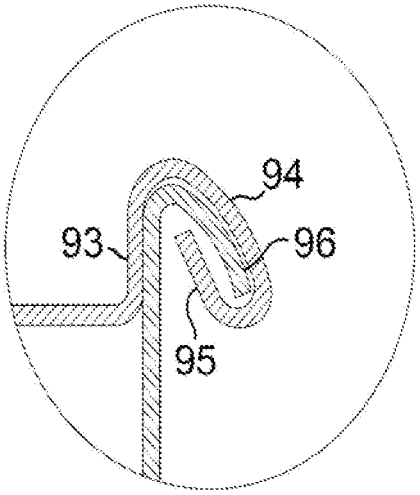
Fig. 2.a
Prior art
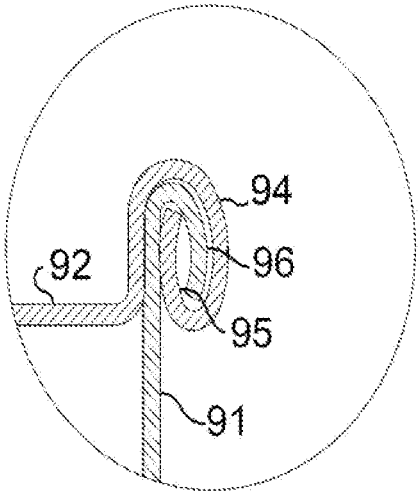
Fig. 2.b
Prior art

IX - IX

X - X

ELECTRONIC CAM-TYPE CAN SEAMER

CROSS REFERENCE TO RELATED APPLICATIONS

This application is a National Stage of International Application No. PCT/EP2017/066699, filed on Jul. 4, 2017, which claims priority from French Patent Application No. 16 57133, filed on Jul. 25, 2016.

TECHNICAL FIELD OF THE INVENTION

The invention relates to the field of crimping of containers, particularly metal containers designed to receive food products. The invention relates more specifically to machines for crimping bases on to so-called "shaped" cans, i.e. those of which the body is not a straight cylinder.

BACKGROUND OF THE INVENTION

With reference to FIGS. 1 and 2, a tin can 90 conventionally comprises a cylindrical body 91 to which a base 92 is applied, held in place by a mandrel (not illustrated). For straight cylinder-shaped boxes, the base 92 is circular and comprises a first peripheral fold 93 extending parallel to the body of the can 90, a second fold 94 extending radially and intended to rest on the top of the body of the can as well as a third fold 95 extending parallel to the first fold 1. The three folds 93 to 95 therefore form a groove, the cross-section of which is substantially in the shape of an inverted U on an upper flared portion 96 of the body 91. The base 92 is crimped on the body 91 by means of a crimping unit. A crimping unit conventionally comprises a support on which the body 91 of can 90 rests, in addition to a winding wheel and a crushing wheel mounted on one end of a winding actuator and a crushing actuator respectively. These actuators can selectively approach their wheels to the top of the body 91 and travel along a circular path around the latter. During a first pass, the winding wheel comes into contact with the third fold 95 and presses it against the mandrel. The winding wheel winds up the second third folds 94 and 95 with the flared portion 96 of the can 90, so as to position the third fold 95 between the outside wall of the can 90 and the flared rim 96 (FIG. 2.*a*). This operation is performed in a single pass, during a relative rotation through 360° of the winding wheel and the edge of the can 90. At the end of the winding pass, the winding wheel is moved away from the edge of the can 90 and the crushing actuator applies the crushing wheel against the edge of the can 90 while applying a crushing force to the fold 94 so as to clamp the second and third folds 94 and 95 against the outer wall of the can 90. The interlocking and crushing of the folds 94-95 of the base 92 with the rim 96 of the can 90 form a sealed crimp (FIG. 2.*b*).

A different crimping unit is used for the operations of crimping so-called "shaped" cans, i.e. those which are not straight cylinders. Indeed, the winding and crushing wheels are required to follow a path corresponding to the periphery of the can. This is generally accomplished by causing the wheels to rotate around a fixed can. Each wheel is mounted on a first end of a lever pivoting on a plate mounted to rotate around an axis of the can to be crimped. The second end of the lever is equipped with a lever arm on the end of which a roller is mounted, interacting with a fixed annular cam, the inner surface of which reproduces the profile of the edge to be crimped—generally with an enlargement coefficient depending on the length of the lever arm. When the plate rotates through 360°, the rollers of each lever follow the cam, which causes movement of their respective wheels along a path corresponding to the profile of the edge to be crimped. A crimping unit of this kind has several disadvantages. Firstly, the cam profile is identical for the winding and crushing wheels. The winding and crushing wheels therefore follow the same path, which may result in defects in the crimping. Winding of the folds is carried out in one pass, meaning that major deformation must be performed in a single pass, which is a source of potential defects. Finally, the change of shape of the can to be crimped involves having a new cam made, dismantling the previous cam in order to be able to mount the new cam on the crimping unit. These operations are costly and require immobilisation of the crimping unit. It is therefore not economical to produce small series or handle production of cans having different shapes using a single crimping unit.

PURPOSE OF THE INVENTION

One aim of the invention is to reduce rejects as a result of crimping defects.

SUMMARY OF THE INVENTION

For this purpose, the invention provides a unit for crimping a base on to a can body comprising a first plate mounted to rotate around a first axis on a frame and connected to first rotational driving means, wherein a first lever is mounted to pivot on the first plate and is equipped on one end with a winding wheel. A second lever is mounted to pivot on the first plate and is equipped at one end with a crushing wheel. According to the invention, a winding actuator is connected to the other end of the first lever and a crushing actuator is connected to the other end of the second lever, with the winding actuator and the crushing actuator being governed by an electronic control unit in order to move the winding wheel and/or the crushing wheel so as to vary the distance between the winding and/or crushing wheel of the first axis according to the angular position of the first plate around the first axis.

Thus, the positions of the crushing and winding wheels are controlled by separate actuators, governed by a control unit allowing programming of different paths of movement for the winding wheel and the crushing wheel. It is subsequently possible to carry out gradual deformations of the edge to be crimped, thereby reducing crimping defects. The electronic control unit can easily pass from one pre-recorded path of movement of the wheels to another, which subsequently allows use of the crimping unit of the invention to perform small crimping series or indeed take charge of unit crimping of cans of different shapes without having to interrupt the supply of cans to the crimping unit.

Also advantageously, the winding actuator comprises a second plate mounted to rotate around the first axis and the second rotational driving means of the second plate, and the crushing actuator comprises a third plate mounted to rotate around the first axis and third rotational driving means of the third plate. Thus, management of the speeds of the rotational driving means makes it possible to influence the relative position of the second and third plates and therefore allows modification of the respective paths of movement of the winding and crushing wheels. According to a preferred embodiment, the first rotational driving means of the first plate comprise a first reduction servomotor, the drive shaft of which is integral with a first pinion interacting with a first toothed wheel integral with the first plate and the second rotational driving means of the second plate comprise a second reduction servomotor, the drive shaft of which is integral with a second pinion interacting with a second toothed wheel integral with the second plate. Finally, the third rotational driving means of the third plate comprise a third reduction servomotor, the drive shaft of which is integral with a third pinion interacting with a third toothed wheel integral with the third plate. A crimping unit that is economical to produce is obtained in this case, employing components (reduction servomotor) that are reliable and commonly used in the industry, the maintenance methods of which are known and mastered, contributing to the reliability of the crimping unit and thereby allowing a reduction in crimping defects.

According to a further preferred embodiment, the first rotational driving means comprise a shaft connecting the first pinion, and the first plate and the second and third driving means respectively comprise a second and a third hollow shaft respectively connecting the second pinion and the second plate in addition to the third pinion and the third plate. The second hollow shaft extends around the first shaft. The third hollow shaft extends around the second hollow shaft. This results in a particularly compact design of the crimping unit.

Also advantageously, the control unit is configured such that each portion of a junction between the base and the can undergoes two passages of a winding wheel before undergoing at least one passage of a crushing wheel. This allows even more gradual execution of the winding phase and therefore a reduction in crimping defects.

BRIEF DESCRIPTION OF THE DRAWINGS

Reference will now be made to the appended drawings, wherein:

FIG. 1 is a cross-sectional diagrammatic representation of a can of the prior art and its base before crimping;

FIG. 2.*a* is a cross-sectional detailed diagrammatic view of the can in FIG. 1 following a first winding pass;

FIG. 2.*b* is a cross-sectional detailed diagrammatic view of the can in FIG. 1 following a first crushing pass;

FIG. 5.*b* is a partial diagrammatic view seen from below of a crimping unit according to the invention;

DETAILED DESCRIPTION OF THE INVENTION

Figure 3:
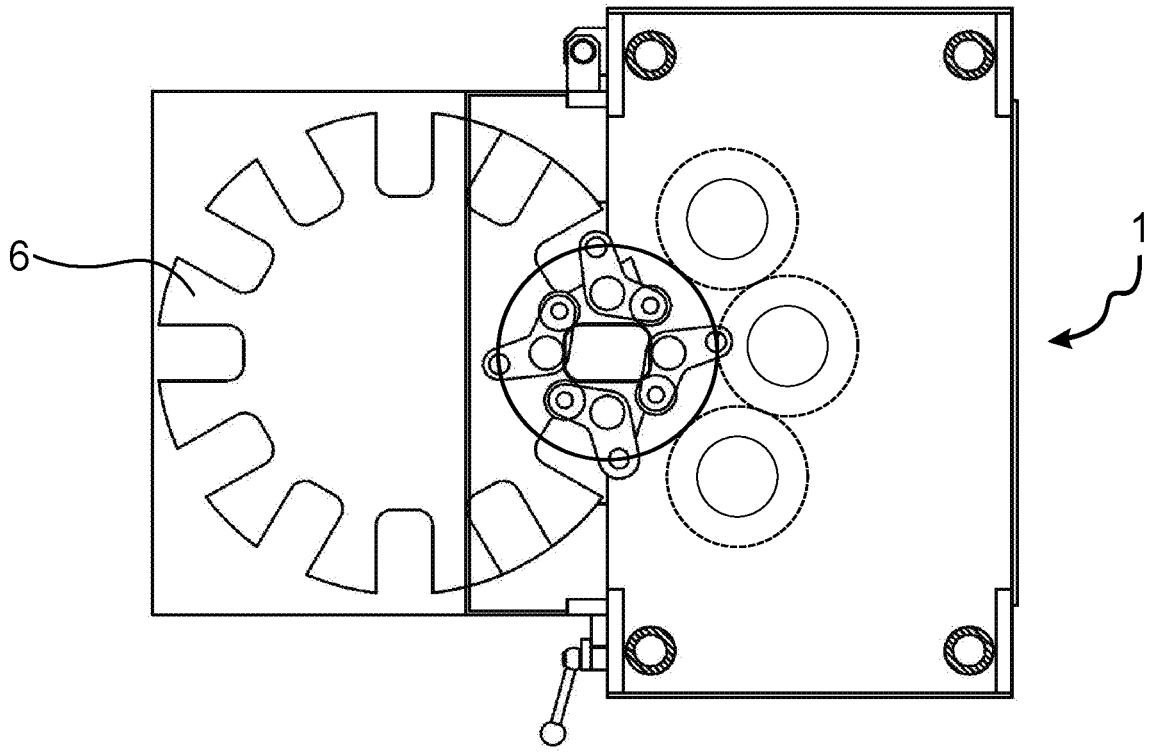
FIG. 3 is a diagrammatic view from above of a crimping unit according to the invention.

With reference to FIGS. 1 to 12, the crimping unit according to the invention, generally designated 1, is intended for crimping a base 92 on to a body 91 of a can 90. The crimping unit 1 comprises a crimping head 2 mounted on a frame 3, the legs 4 of which are equipped with jacks 5 allowing adjustment of the height of the frame 3. The crimping unit 1 is generally attached to a supply carousel 6 known to the person skilled in the art and comprises a first plate 10 mounted to rotate around a first Oy axis, in this case a vertical axis, on a frame 4. The first plate 10 is rotationally driven by a first reduction servomotor 11, the drive shaft 12 of which is integral with a first pinion 13 interacting with a first toothed wheel 14. The first toothed wheel 14 is mounted to rotate around a mandrel support shaft 40, one end 41 of which is integral with the frame 4 and the other end of which bears a mandrel 42 to immobilise movement of the base 90 in a horizontal plane. A first hollow shaft 15 extends along the Oy axis around the mandrel support shaft 40 and connects the first toothed wheel 14 to the first plate 10. Thus, the first plate 10 is connected to the first reduction servomotor 11 via the first hollow shaft 15 and the gear formed by the first toothed wheel 14 and the first pinion 13. The first plate 10 receives two levers 50 and 51, mounted to pivot on the first plate 10, each of which is equipped at their respective first ends 52 and 53 with a winding wheel, respectively 54 and 55. The respective pivots 56 and 57 of the levers 50 and 51 are located on a first diameter 58 of the first plate 10, on either side of the centre of the first plate 10.

The first plate 10 also receives two levers 60 and 61, mounted to pivot on the first plate 10, each of which is equipped at their respective first ends 62 and 63 with a crushing wheel, respectively 64 and 65. The respective pivots 66 and 67 of the levers 60 and 61 are located on a first diameter 68 of the first plate 10, on either side of the centre of the first plate 10, with the second diameter 68 being orthogonal to the first diameter 58.

The lever 50 forms a first lever and the lever 60 forms a second lever. The lever 51 forms a third lever and the lever 61 forms a fourth lever.

The crimping unit 1 also comprises a second plate 20 mounted to rotate around the first Oy axis. The second plate 20 is rotationally driven by a second reduction servomotor 21, the drive shaft 22 of which is integral with a second pinion 23 interacting with a second toothed wheel 24. A second hollow shaft 25 extends along the Oy axis around the first shaft 15 and connects the second toothed wheel 24 to the second plate 20. The outer surface 16 of the first shaft 15 is bronze-coated in order to facilitate the relative rotation of the first shaft 15 and the second shaft 25. Thus, the second plate 20 is connected to the second reduction servomotor 21 via the second hollow shaft 25 and the gear formed by the second toothed wheel 24 and the second pinion 23.

The second plate 20 features two ears 26 and 27 that respectively receive control spindles 70 and 71, each connected to the second ends 72 and 73 of the first lever 50 and of the third lever 51.

The crimping unit 1 also comprises a third plate 30 mounted to rotate around the first Oy axis. The third plate 30 is rotationally driven by a third reduction servomotor 31, the drive shaft 32 of which is integral with a third pinion 33 interacting with a third toothed wheel 34. A third hollow shaft 35 extends along the Oy axis around the second shaft 25 and connects the third toothed wheel 34 to the third plate 30. The outer surface 26 of the second shaft 25 is bronze-coated in order to facilitate the relative rotation of the second shaft 25 and the third shaft 35. Thus, the third plate 30 is connected to the third reduction servomotor 31 via the third hollow shaft 35 and the gear formed by the third toothed wheel 34 and the third pinion 33. The third plate 30 features two ears 36 and 37 that respectively receive control spindles 74 and 75, each connected to the second ends 76 and 77 of the second lever 60 and of the fourth lever 61.

Figure 5A:
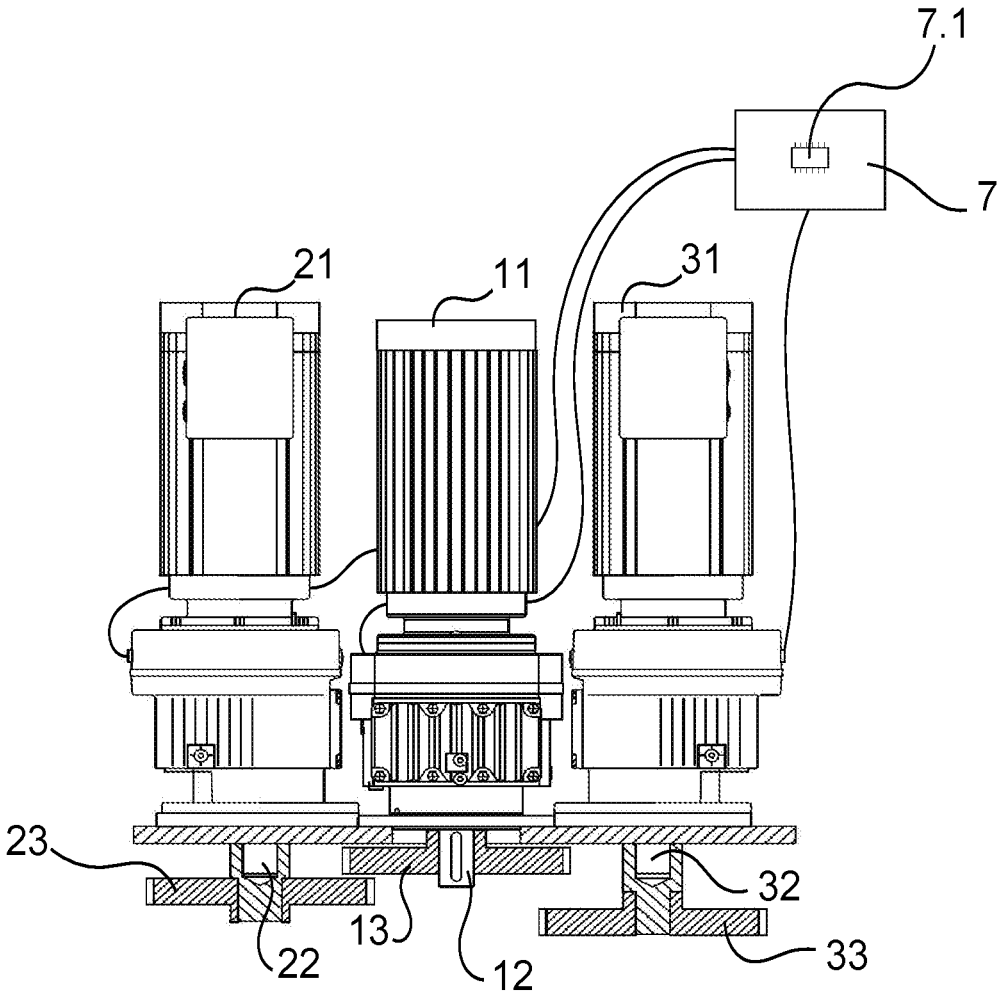
FIG. 5.*a* is a vertical cross-sectional partial diagrammatic view of a crimping unit according to the invention.
Figure 5B:
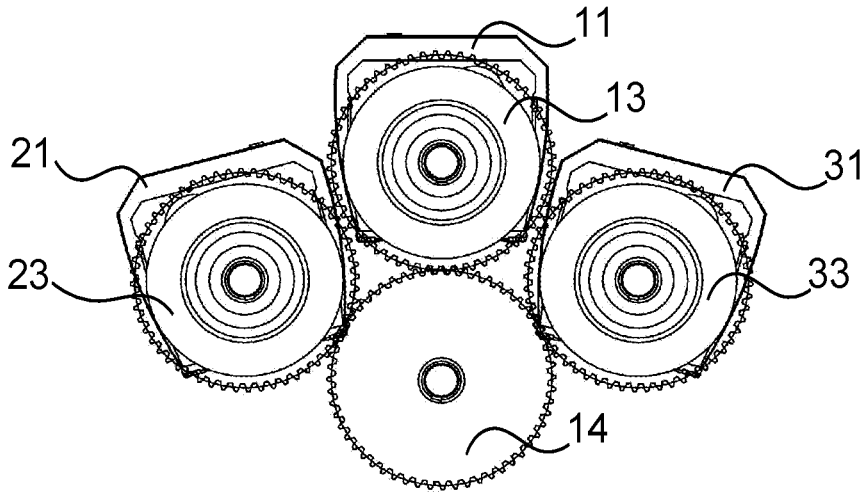
Figure 6A:
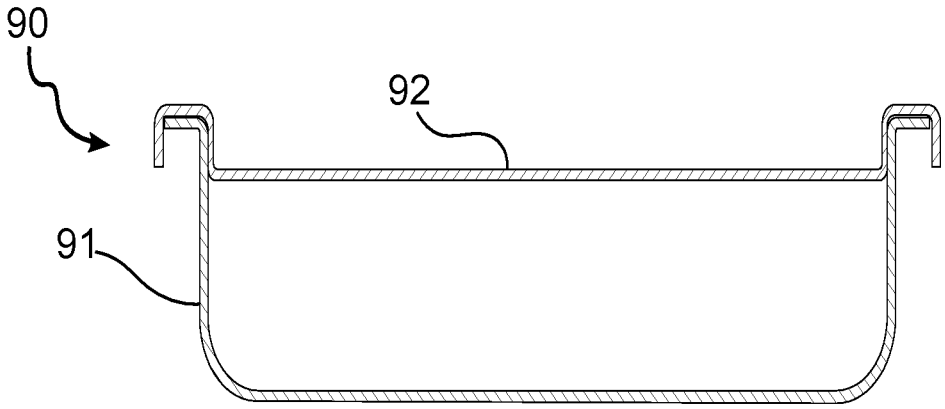
FIGS. 6.*a* to 6.*d* are cross-sectional views of a can to be crimping during the different stages of the process of the invention.
Figure 6B:
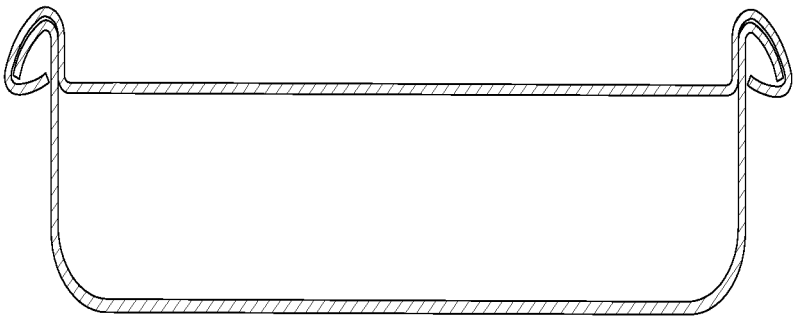
Figure 6C:
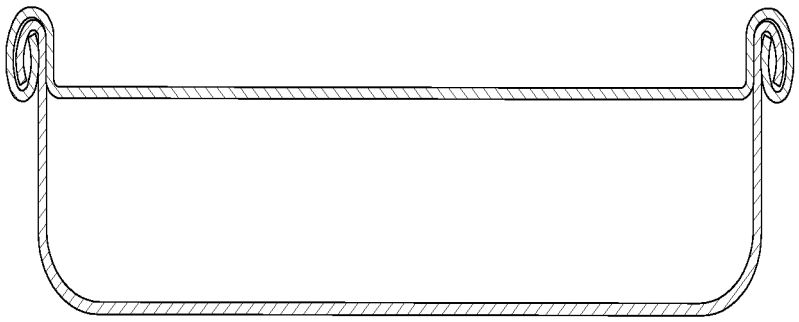
Figure 6D:
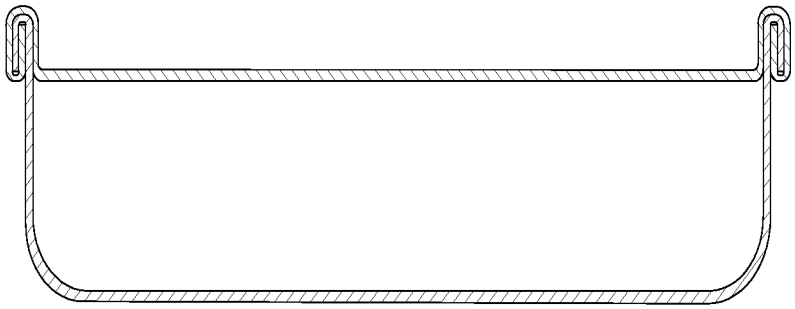
Figure 7:
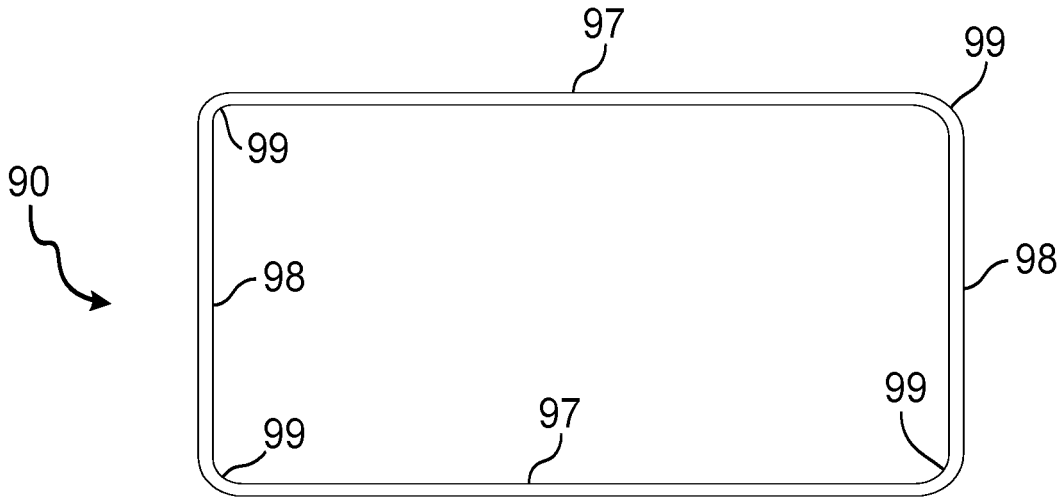
FIG. 7 is a perspective diagrammatic view of a can to be crimped.
Figure 8:
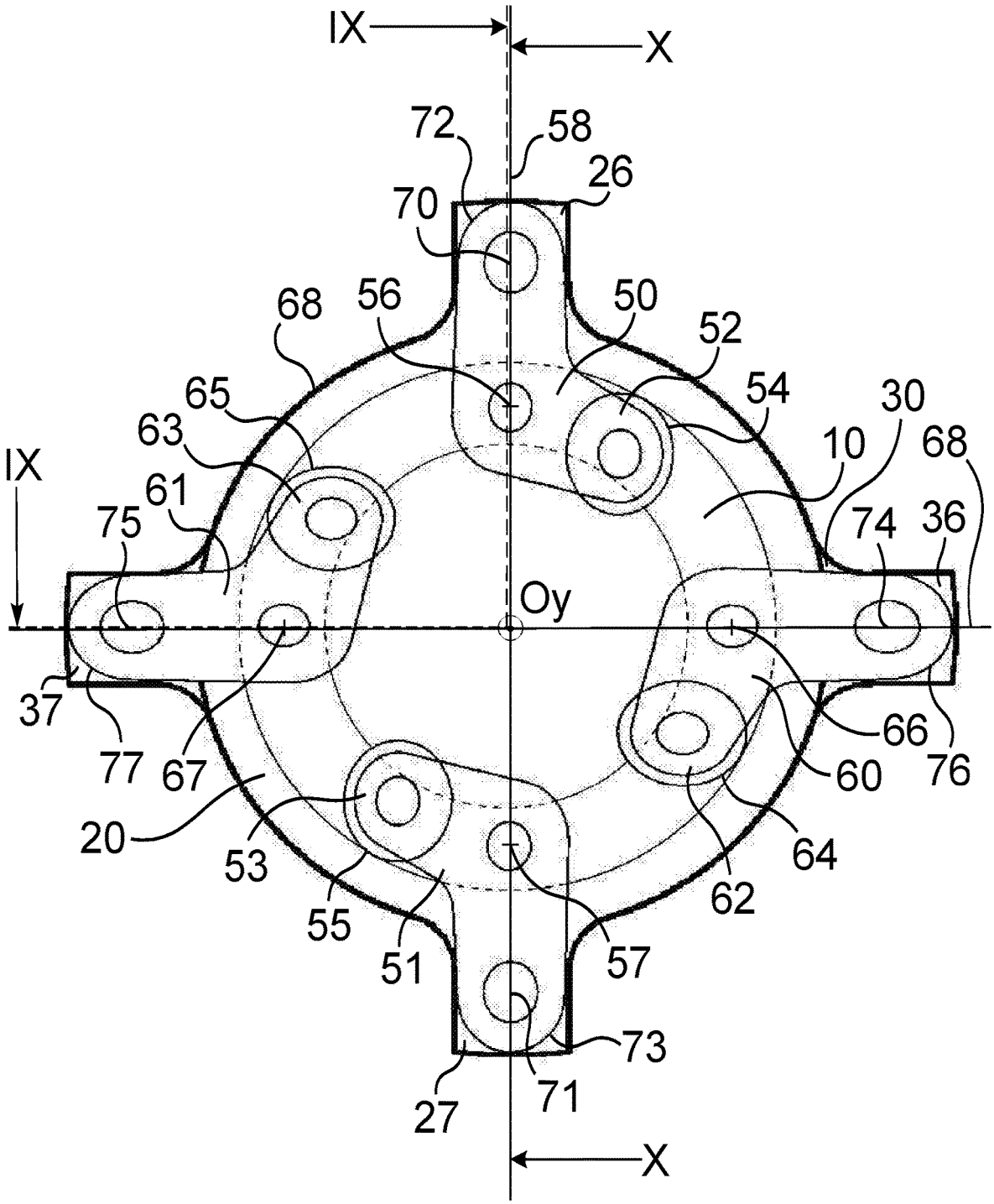
FIG. 8 is a detailed horizontal cross-sectional view of the crimping head of the crimping unit according to the invention in a first configuration.

As can be seen in FIG. 5.*a*, the first, second and third plates 10, 20 and 30 in addition to the first, second and third pinions 13, 23 and 33 as well as the first, second and third toothed wheels 14, 24 and 34 are situated on different levels so as to avoid any interference.

The first, second and third reduction servomotors 11, 21 and 31 are connected to a control unit 7 comprising an electronic calculator 7.1. Within the meaning of the present invention, the term "electronic calculator" denotes a calculator comprising components operating under weak currents and designed to produce control instructions for external electrical elements.

The following elements:

second reduction servomotor 21;

gear consisting of the second toothed wheel 23 and the second pinion 24;

second shaft 25;

and second plate 20, form the winding actuator 28. This actuator 28 is connected to the second end 72 of the first lever 50 by the control spindle 70 engaged in the ear 26 and to the second end 73 of the third lever 51 by the control spindle 71 engaged in the ear 27.

The following elements:

third reduction servomotor 31;

gear consisting of the third toothed wheel 33 and the third pinion 34;

third shaft 35;

and third plate 30, form the crushing actuator 38. This actuator 38 is connected to the second end 76 of the first lever 60 by the control spindle 74 engaged in the ear 36 and to the second end 77 of the third lever 61 by the control spindle 75 engaged in the ear 37.

Figure 9:
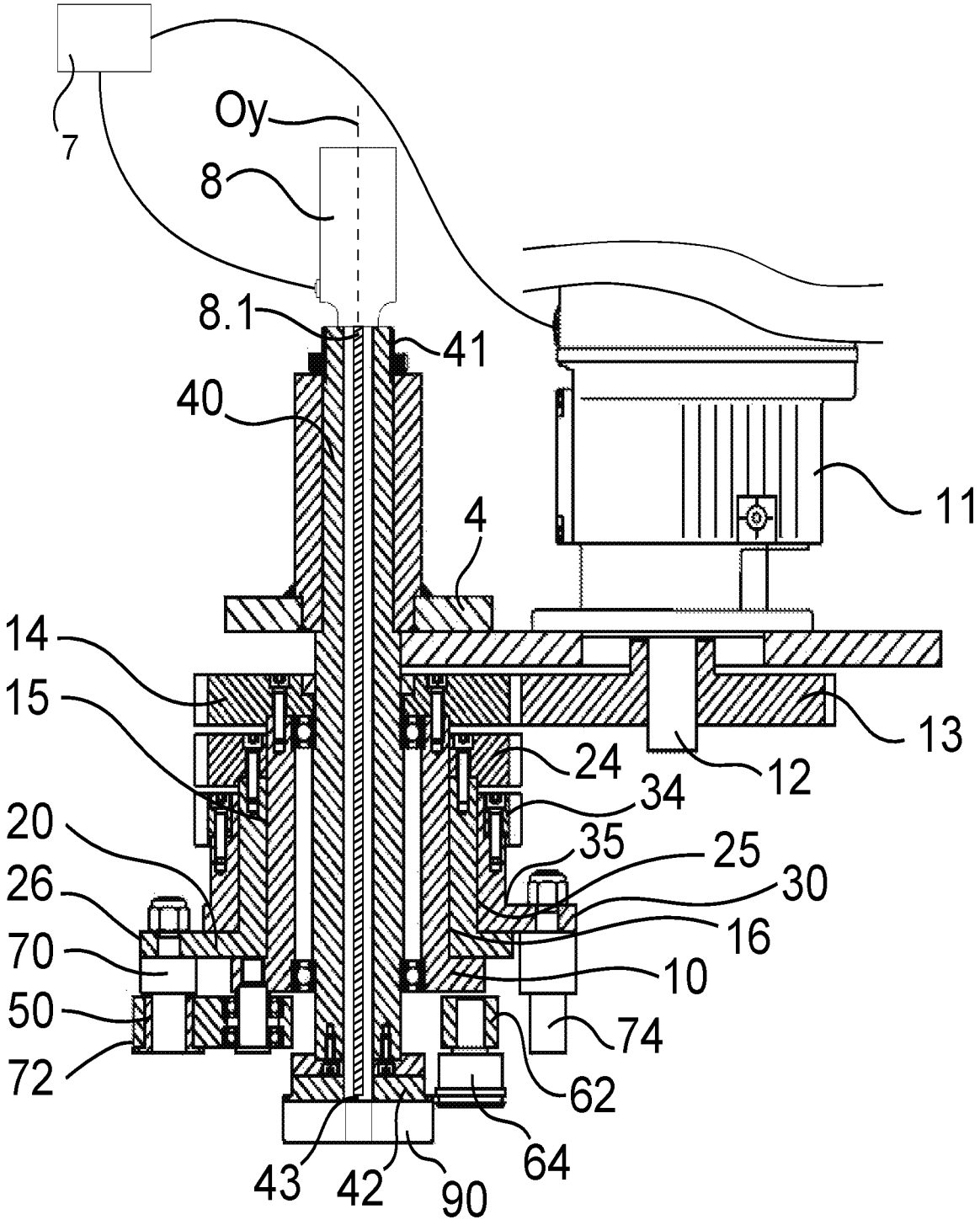
FIG. 9 is a vertical cross-sectional detailed diagrammatic view broken along a IX-IX plane represented in FIG. 8 of the crimping unit in FIG. 8.
Figure 10:
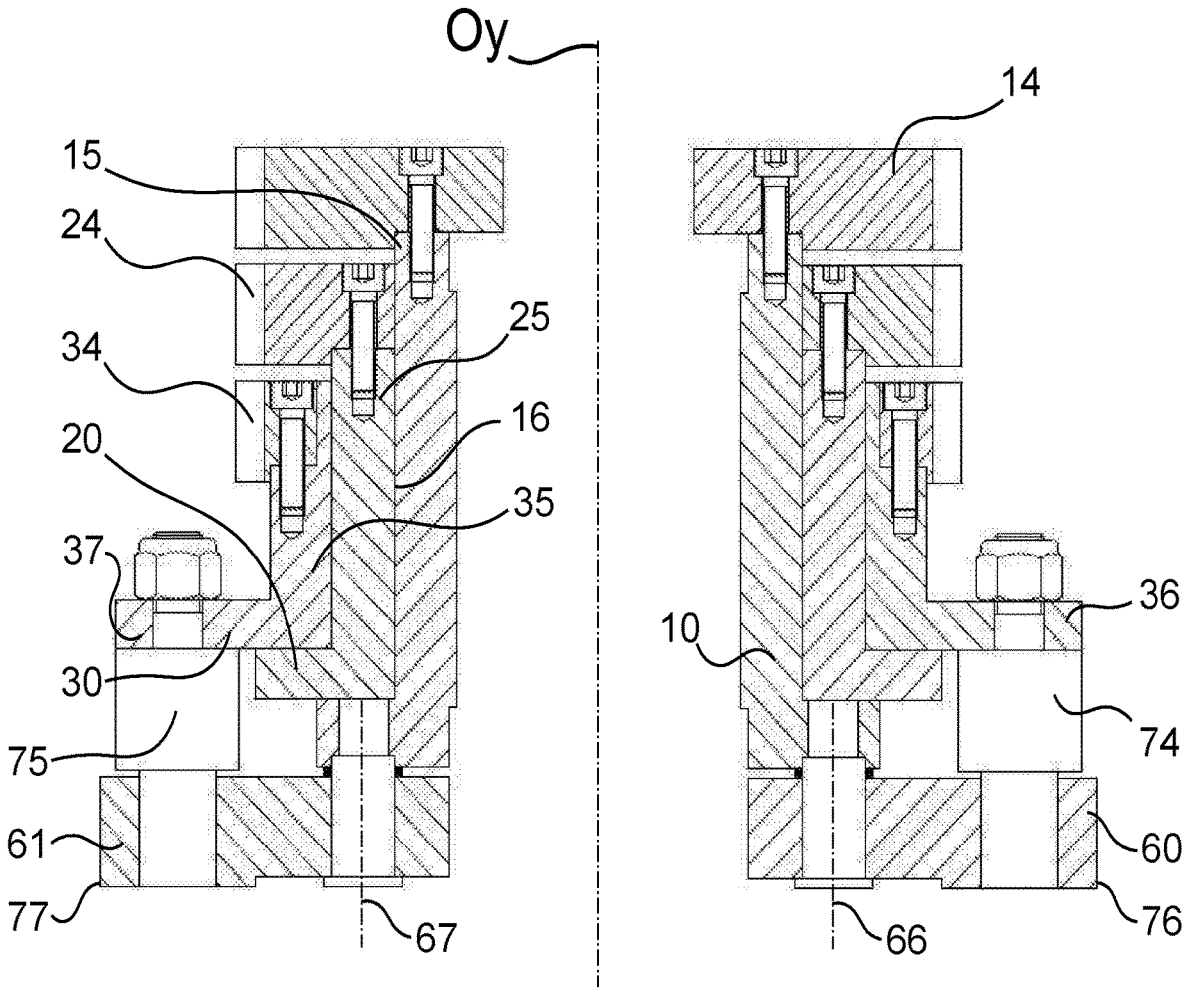
FIG. 10 is a cross-sectional view an X-X plane represented in FIG. 8 of the crimping unit in FIG. 8.

As can be seen in FIG. 9, an electric jack 8 is fixed to the end 41 of the hollow shaft 40. The rod 8.1 of the electric jack 8 extends through the hollow shaft up to an orifice 43 passing through the mandrel 42. The electric jack 8 is also connected to the control unit 7.

Figure 4:
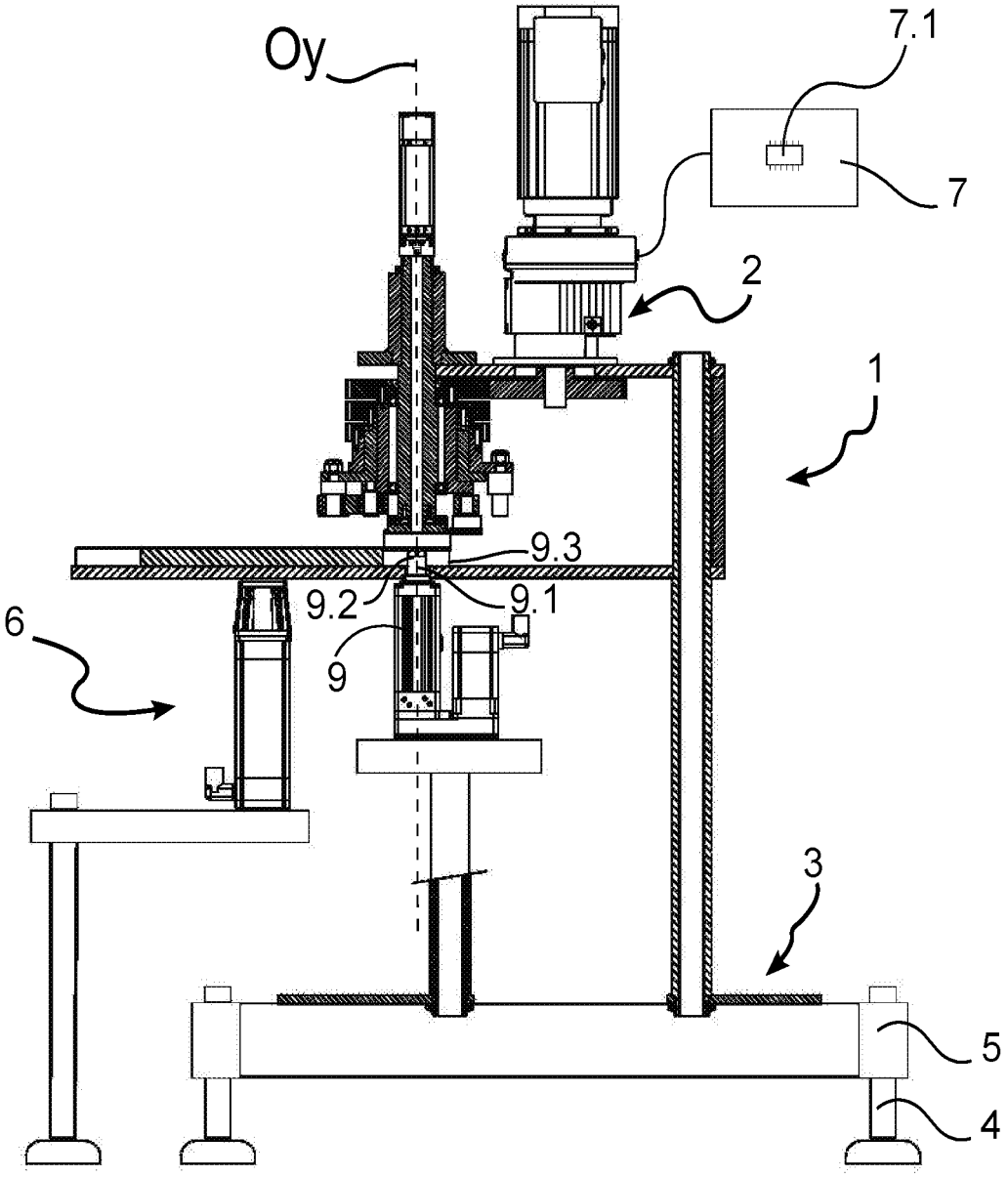
FIG. 4 is a vertical cross-sectional diagrammatic view of a crimping unit according to the invention.

Advantageously and as can be seen in FIG. 4, the frame 3 comprises an electric jack 9, the rod 9.1 of which extends along the Oy axis. The end 9.2 of the rod 9.1 bears a plate 9.3 designed to receive a body 91 of the can 90 to be crimped.

The control unit 7 is arranged so as to be able to control in real time the speeds of rotation ω11, ω21, ω31 of the first, second and third reduction servomotors 11, 21 and 31 respectively and thus their respective angular positions.

Figure 13:
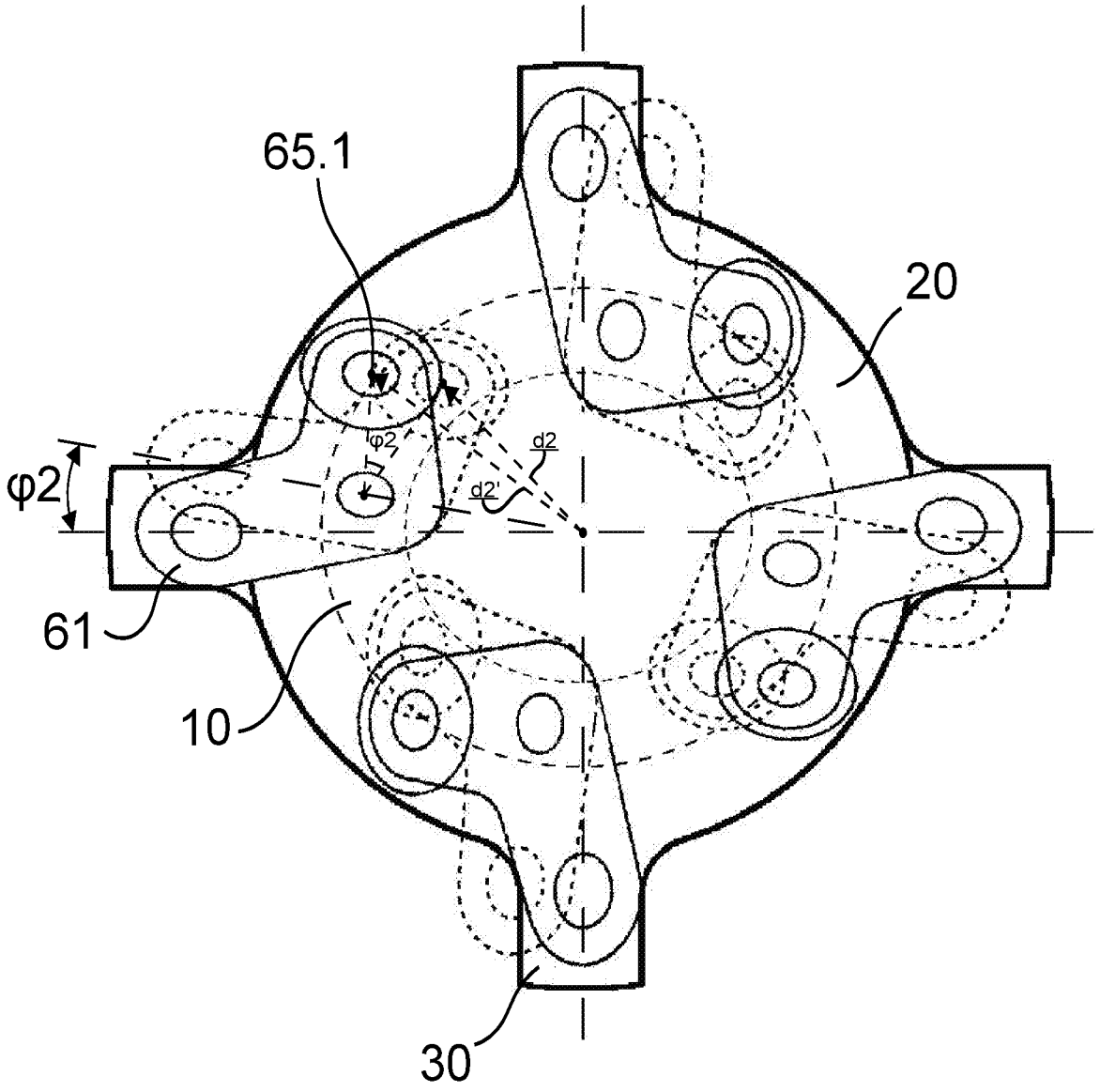
FIGS. 13 to 25 are views identical to that in FIG. 7 of the crimping head in different crimping phases.

By adjusting the speeds of rotation $\omega_{11}$, $\omega_{21}$, $\omega_{31}$, the control unit 7 can subsequently introduce:

a) an angular offset $\varphi_1$ between the first plate 10 and the second plate 20 (FIG. 12) and/or;

b) an angular offset $\varphi_2$ between the first plate 10 and the third plate 30 (FIG. 13).

Figure 11:
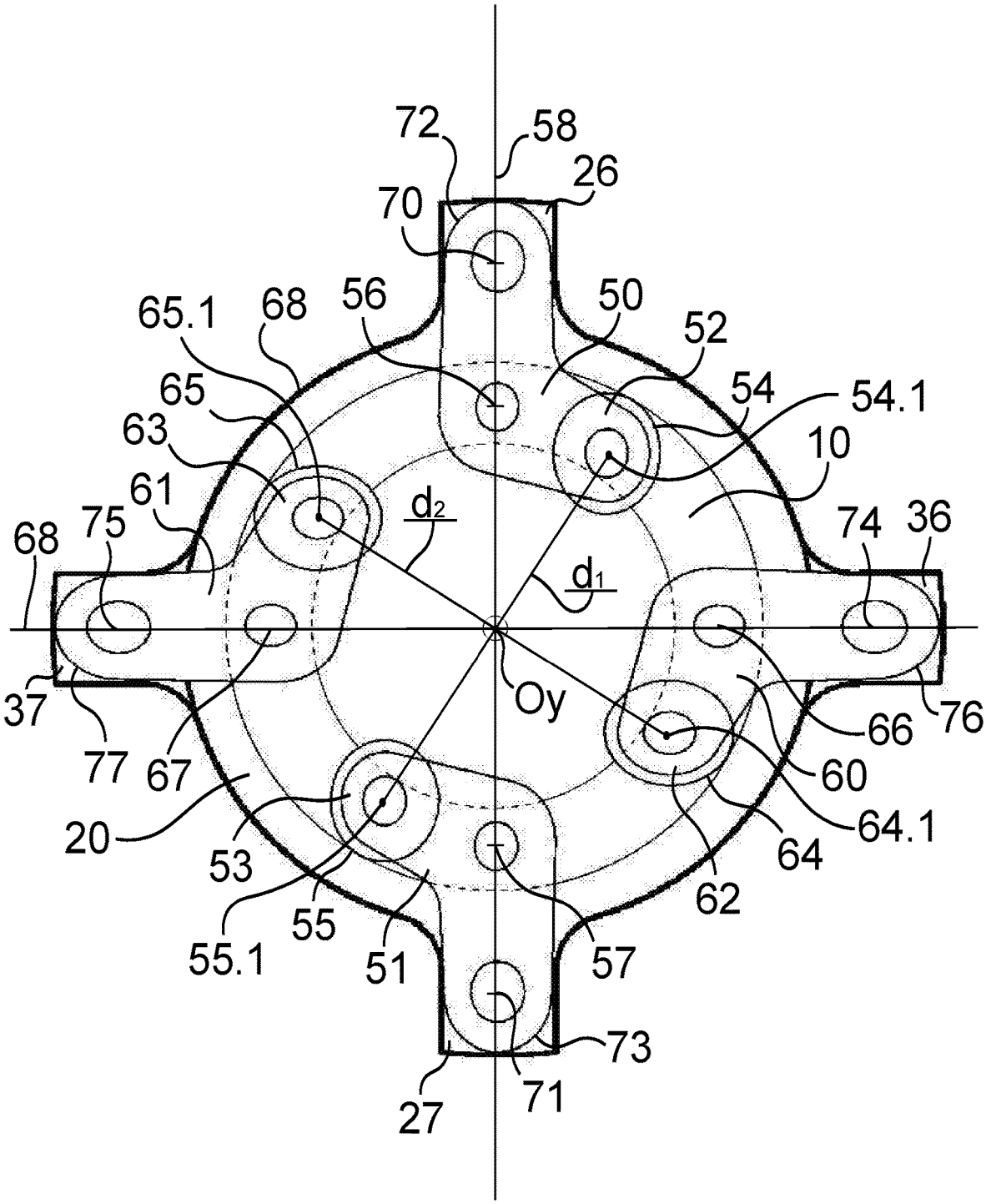
FIG. 11 is a view identical to that in FIG. 8 of the crimping unit according to the invention in a second configuration.

For example, a fixed angular offset $\varphi_1$ can be established between the first plate 10 and the second plate 20 by selectively increasing the speed of rotation $\omega_{11}$ of the first reduction servomotor 11 in relation to the speed of rotation $\omega_{21}$ of the second reduction servomotor 21 and subsequently by bringing the two speeds of rotation $\omega_{11}$ of the first reduction servomotor 11 and $\omega_{21}$ of the second reduction servomotor 21 to the same value. FIG. 11 represents a first configuration of the crimping unit 1 wherein the angular offset $\varphi_1$ between the first and second plate is zero. In this first configuration, the axes 70, 71 and the pivots 56 and 57 respectively of the first lever 50 and the third lever 51 are aligned on the same diameter 58 of a circle passing through pivots 56 and 57 and the centre of which is located on the Oy axis. In this first configuration, the respective centres 54.1 and 55.1 of the winding wheels 54 and 55 are at a distance $d_1$ from the Oy axis (distance considered in a plane perpendicular to the Oy axis). The first configuration illustrated in FIG. 11 also comprises a zero angular offset $\varphi_2$ between the first plate 10 and the third plate 30. In this first configuration, the axes 74, 75 and the pivots 66 and 67 respectively of the second lever 60 and the fourth lever 61 are aligned on the same diameter 68 of a circle passing through pivots 66 and 67 and the centre of which is located on the Oy axis. In this first configuration, the respective centres 64.1 and 65.1 of the crushing wheels 64 and 65 are at a distance $d_2$ from the Oy axis (distance considered in a plane perpendicular to the Oy axis). It should be noted that in the specific case illustrated in FIG. 11, the pivots 56, 57, 66 and 67 are all situated on the same circle and the distances $d_1$ and $d_2$ are equal.

In this first configuration, when the respective speeds of rotation $\omega_{11}$, $\omega_{21}$, $\omega_{31}$ of the first, second and third reduction servomotors 11, 21 and 31 are equal, the winding wheels 52 and 53 in addition to the crushing wheels 62 and 63 follow a circular path of a diameter $d_1=d_2$.

Figure 12:
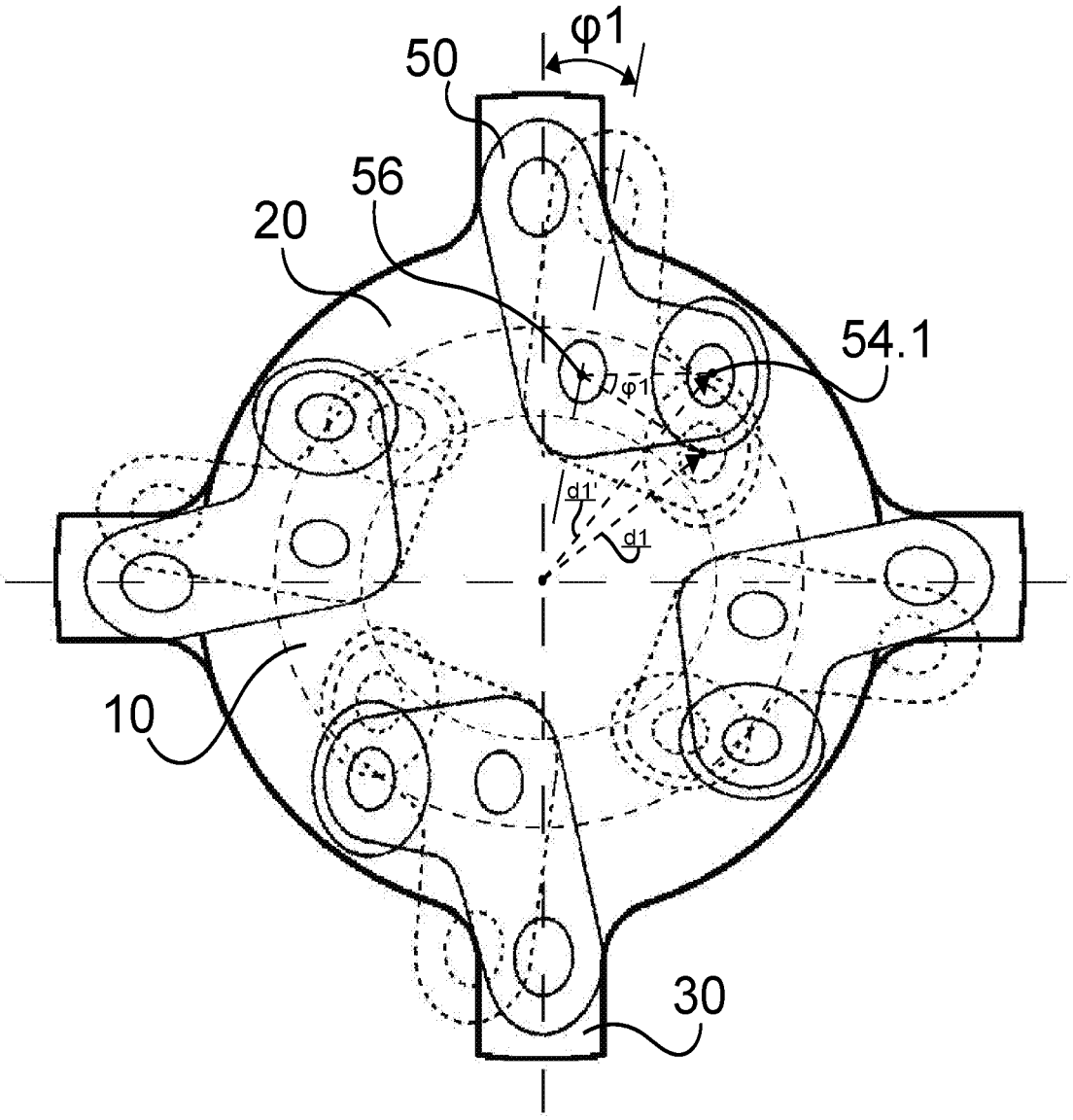
FIG. 12 is a view identical to that in FIG. 8 of the crimping unit according to the invention in a third configuration.

FIG. 12 represents a second configuration wherein the angular offset $\varphi_1$ between the first plate 10 and the second plate 20 is non-zero. In this case, and according to the illustration in FIG. 12, the angular offset $\varphi_1$ between the first plate 10 and the second plate 20 is negative. In this second configuration, the lever 50 a executes a rotation around the pivot 56 equal to the value of the angular offset $\varphi_1$ between the first plate 10 and the second plate 20 from its position corresponding to the first configuration and shown in dotted lines in FIG. 10. The distance $d_1'$ between the respective centres 54.1 and 55.1 of the winding wheels 54 and 55 of the Oy axis is in this case greater than the distance $d_1$.

Likewise, a positive angular offset $\omega_1$ between the first plate 10 and the second plate 20 results in a reduction in the distance $d_1'$ between the respective centres 54.1 and 55.1 of the winding wheels 54 and 55 of the Oy axis in relation to the distance $d_1$.

As illustrated in FIG. 13, a negative angular offset $\varphi_2$ between the first plate 10 and the third plate 30 results in moving away of the respective centres 64.1 and 65.1 of the crushing wheels 64 and 65 of the Oy axis in relation to their position shown in FIG. 9. This corresponds to an increase in the distance $d_2'$ between the respective centres 64.1 and 65.1 of the crushing wheels 64 and 65 of the Oy axis in relation to the distance $d_2$.

Likewise, a positive angular offset $\varphi_2$ between the first plate 10 and the third plate 30 results in a reduction in the distance $d_2'$ between the respective centres 64.1 and 65.1 of the winding wheels 64 and 65 of the Oy axis in relation to the distance $d_1$.

Functioning of the crimping unit 1 will now be described while referring to FIGS. 14 to 25. For the sake of clarity, only the positions of the levers 50, 51, 60 and 61 in relation to a can 90 are illustrated.

Figure 14:
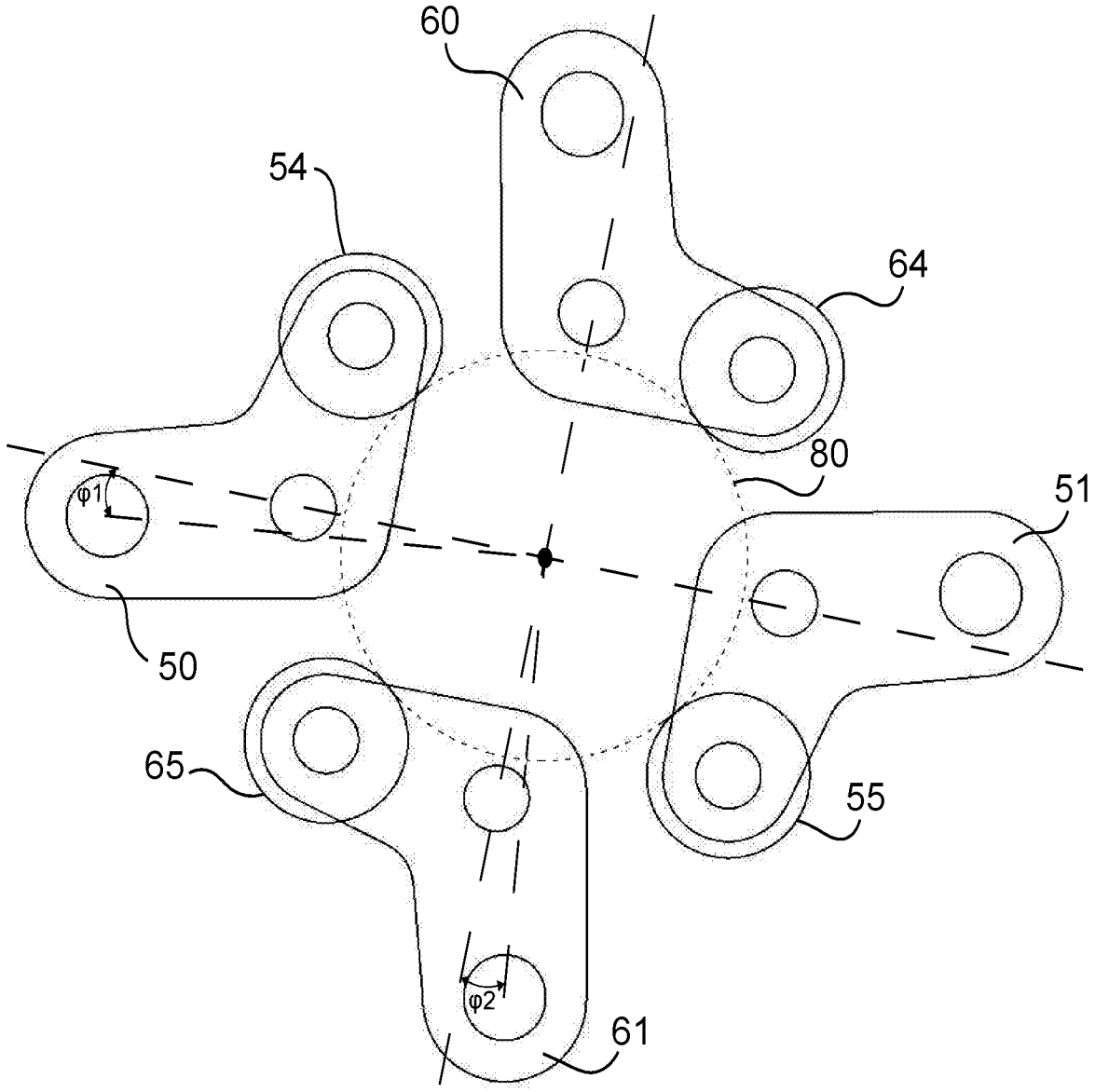

According to an initial preliminary stage, the control unit 7 commands a negative angular offset $\varphi_1$ between the first plate 10 and the second plate 20 and a negative angular offset $\varphi_2$ between the plate 10 and the second plate 30. This solution is illustrated in FIG. 14. In the specific case illustrated in FIG. 14, the angular offsets $\varphi_1$ and $\varphi_2$ are equal. The winding wheels 54 and 55 in addition to the crushing wheels 64 and 65 follow a circular clearance profile 80 in which they are not in contact with the can 90 to be crimped.

According to a second stage, the supply carousel 6 brings on to the plate 9.3 a can 90 consisting of a body 91 with a base 92 resting on top that is not crimped directly above the mandrel 42. The can 90 is a can with a substantially rectangular cross-section comprising edges of greater length connected to edges 98 of lesser length by fillets 99 (refer to FIG. 7).

Figure 15:
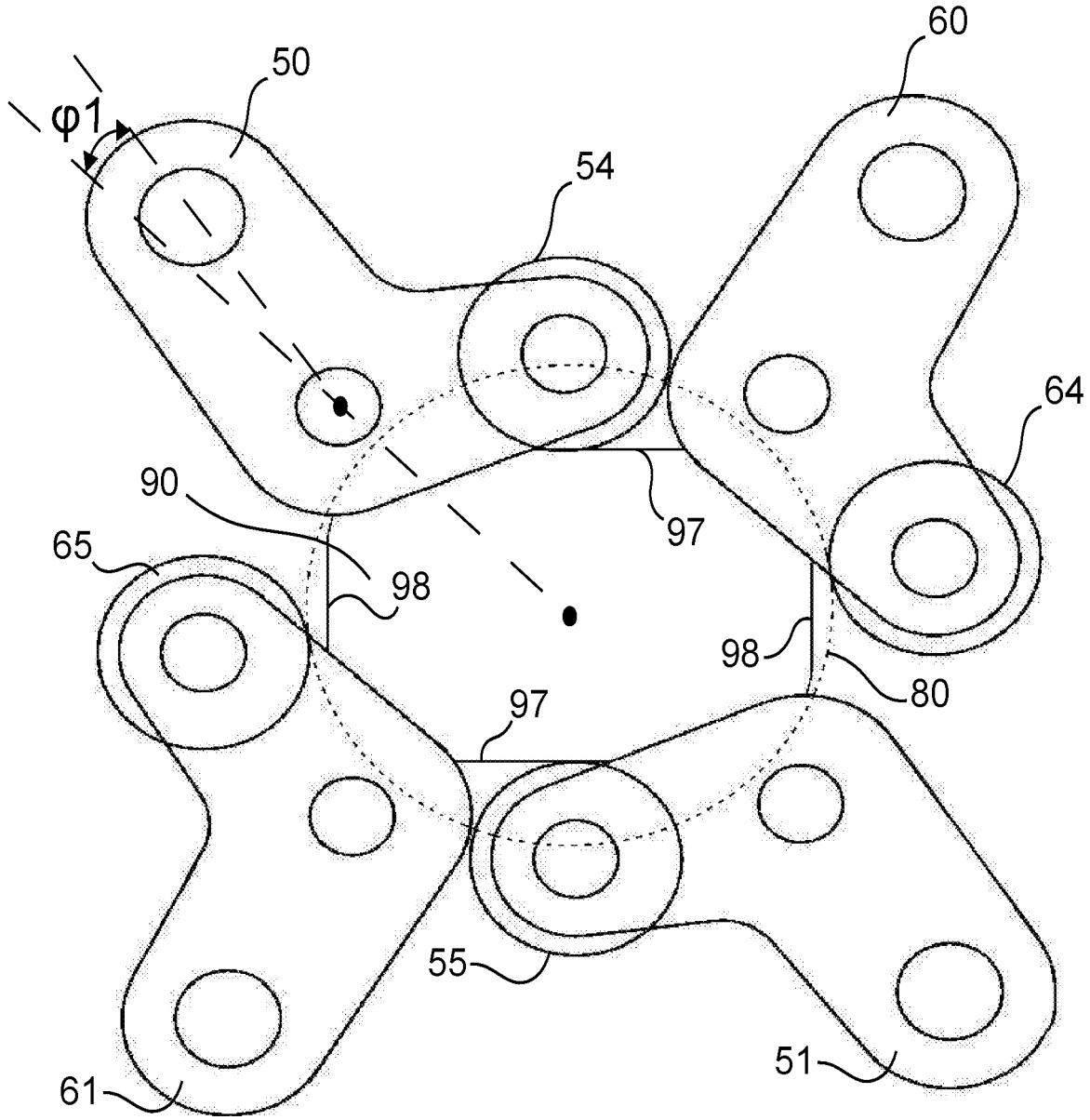
Figure 16:
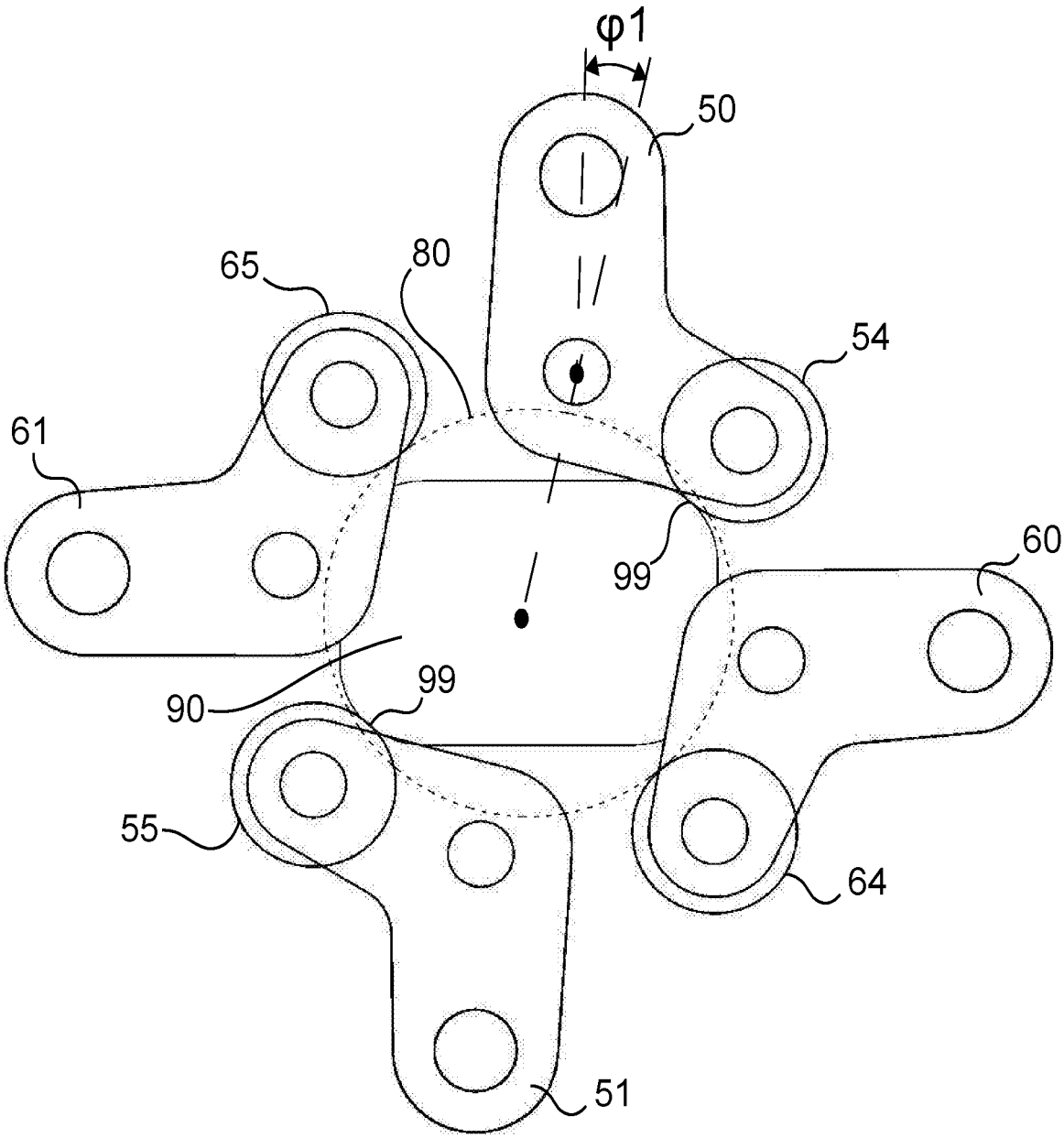
Figure 17:
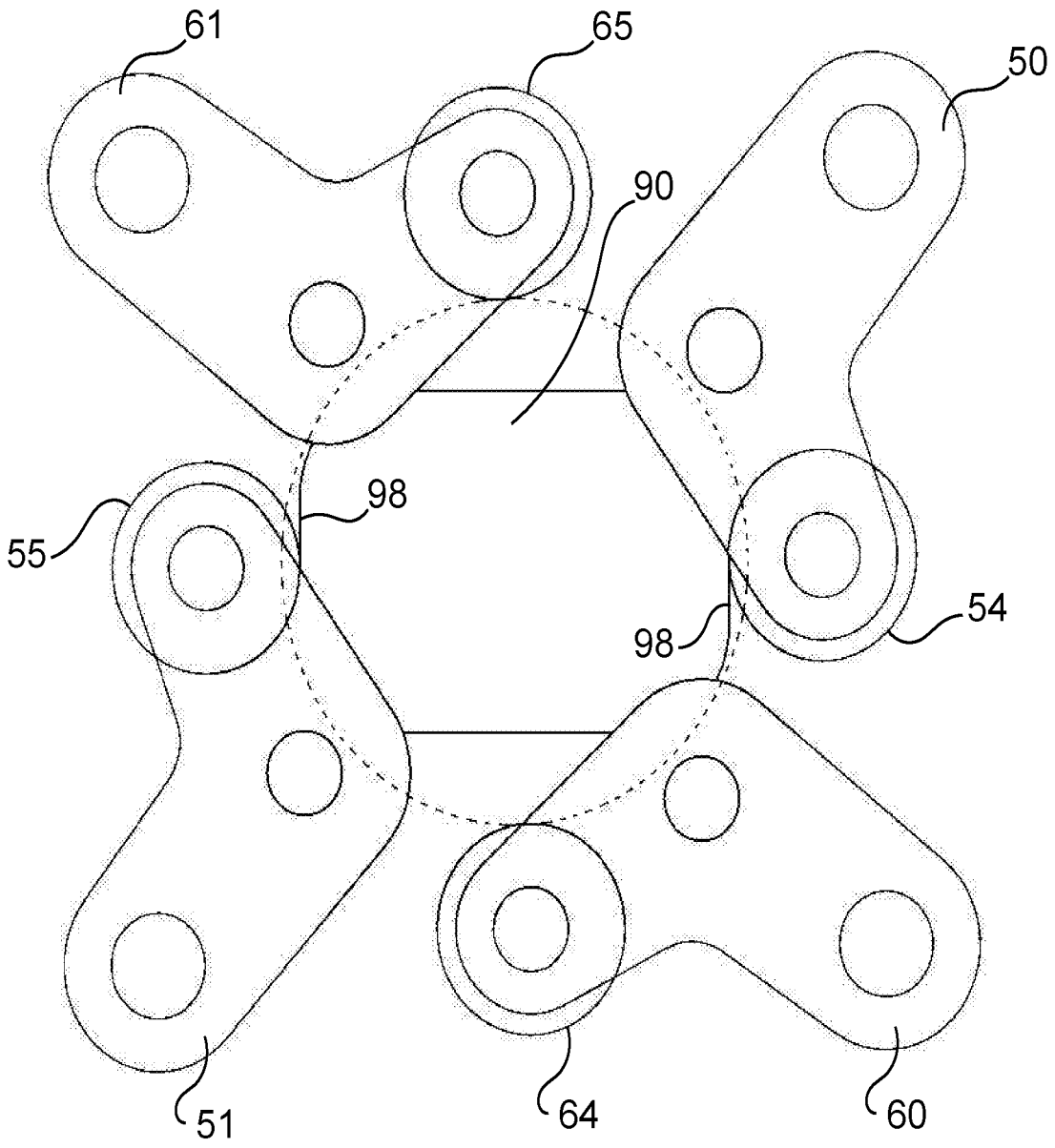
Figure 18:
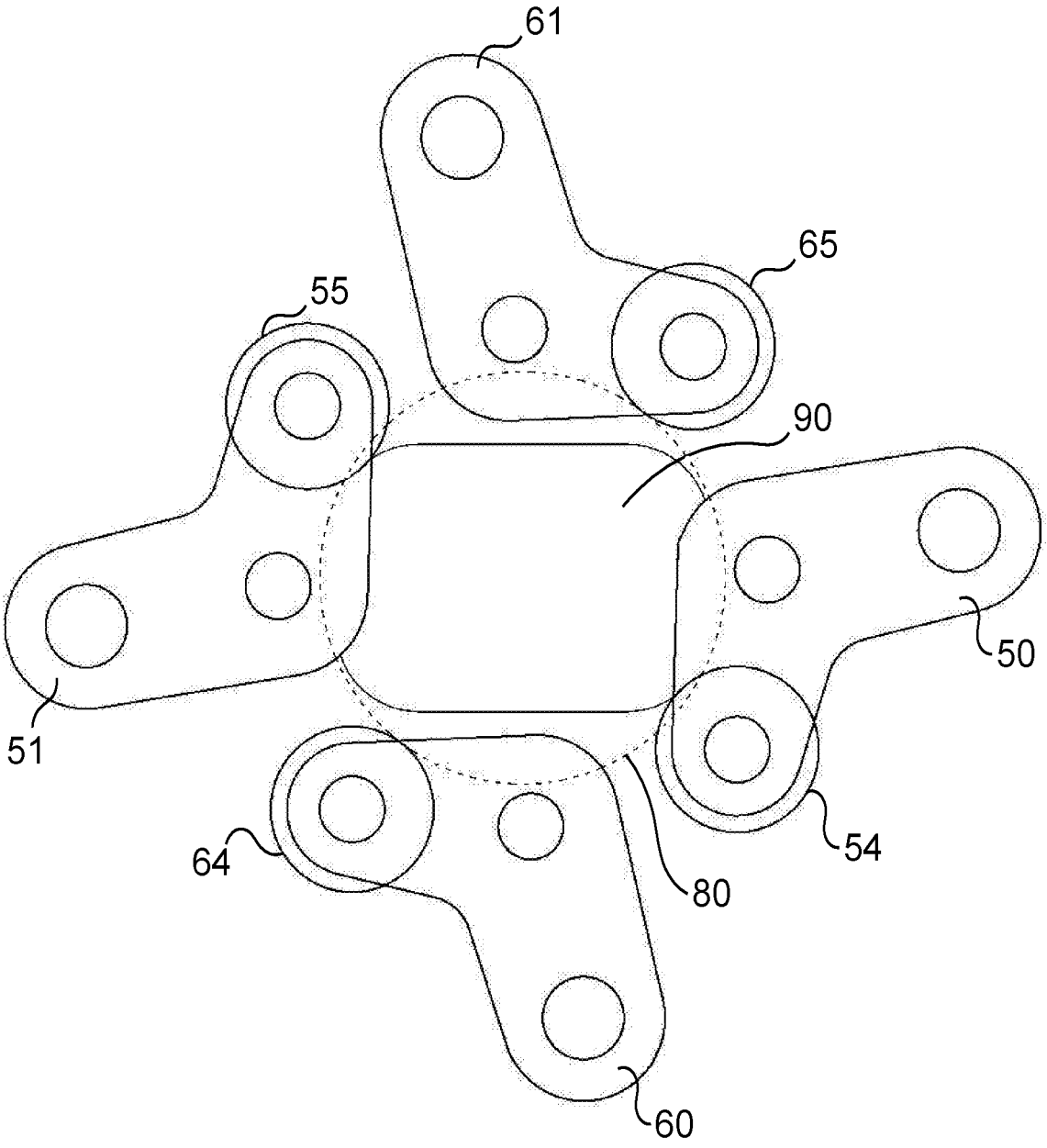
Figure 19:
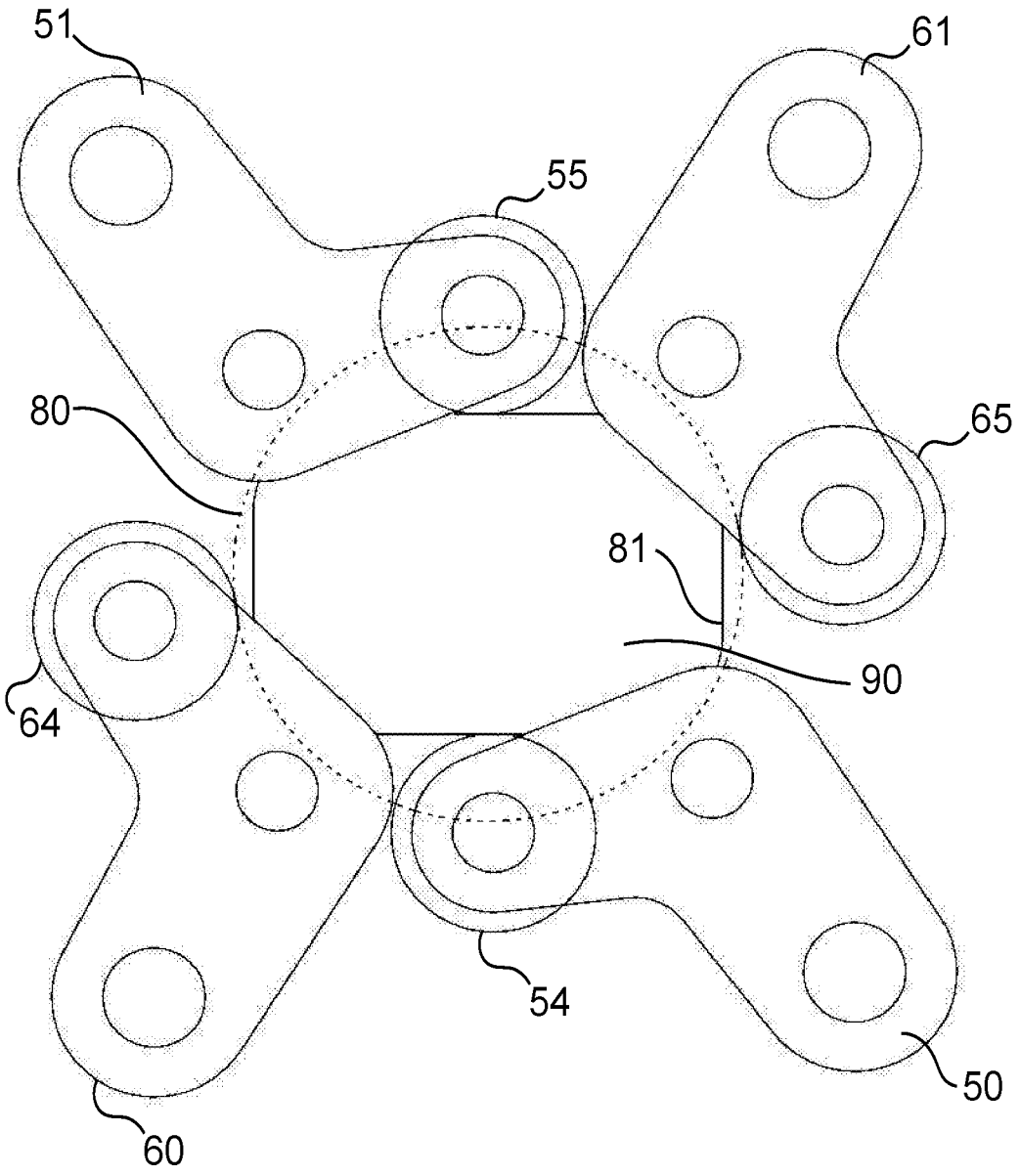

According to a fourth stage, the control unit 7 commands a positive angular offset $\varphi_1$ between the first plate 10 and the second plate 20, which causes the winding wheels 54 and 55, which come into contact with the edges 97 of the can 90, to move closer together (FIG. 15). As the first, second and third plates 10, 20 and 30 rotate, the control unit 7 changes the value of the angular offset $\varphi_1$ so that the winding wheels 54 and 55 follow a first winding pass profile. During this stage, the winding wheels 54 and 55 follow the edges 97 of the can (FIG. 15) and subsequently the fillets 99 (FIG. 16) before following the edges 98 (FIG. 17) and the last two fillets 99 (FIG. 18). The first winding pass is completed when the winding wheel 54 has reached the position occupied by the winding wheel 55 at the beginning of the fourth stage (FIG. 19). During this first winding pass, the angular offset $\varphi_2$ has not changed and the crushing wheels 64 and 65 have remained on the clearance path 80. The edge of the can 90 a then has a section illustrated in FIG. 6.*b*. It should be noted that combined use of the winding wheels 54 and 55 makes it possible to carry out the first winding phase in a 180-degree rotation of the first plate 10 relative to the can 90.

Figure 20:
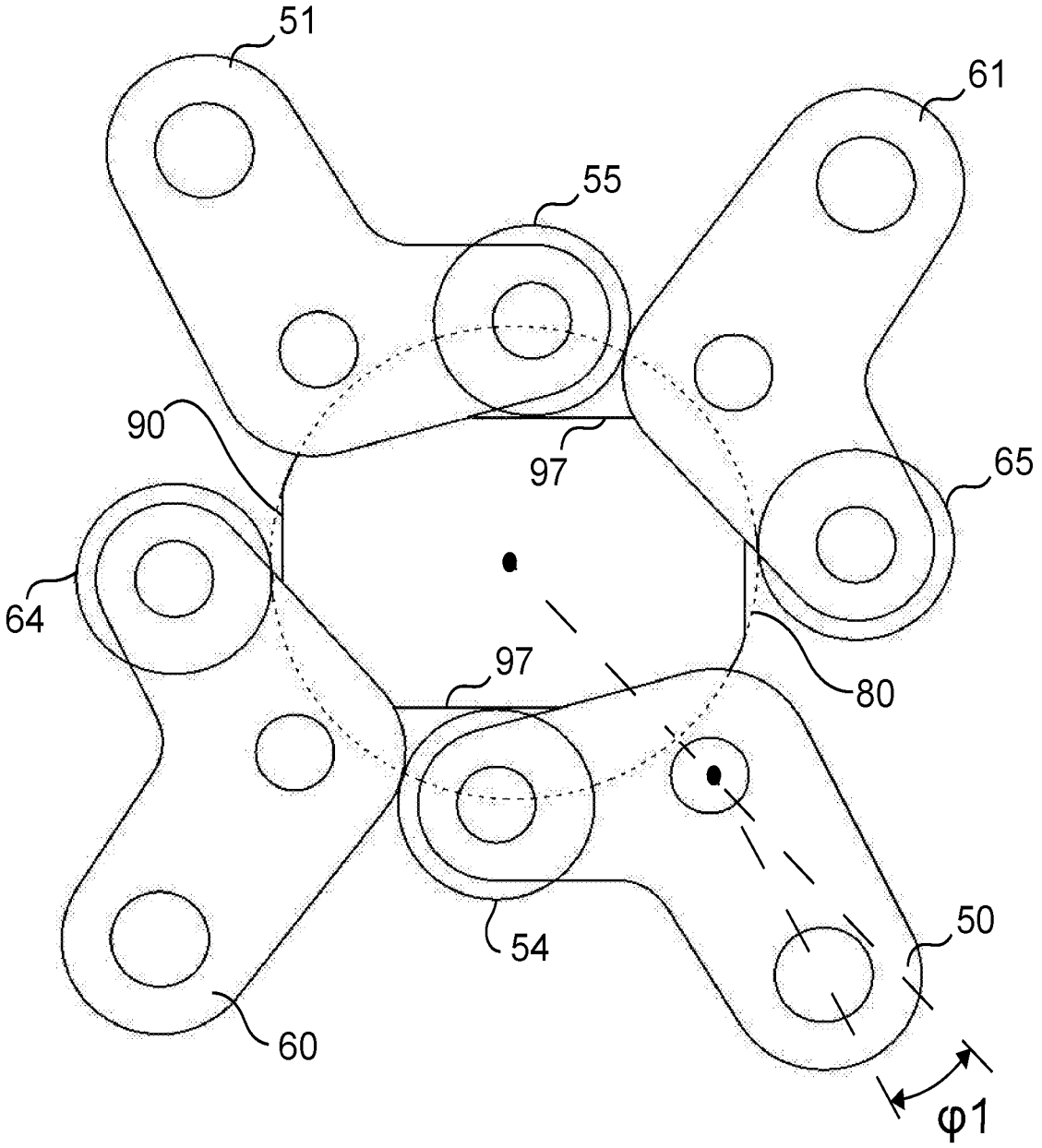
Figure 21:
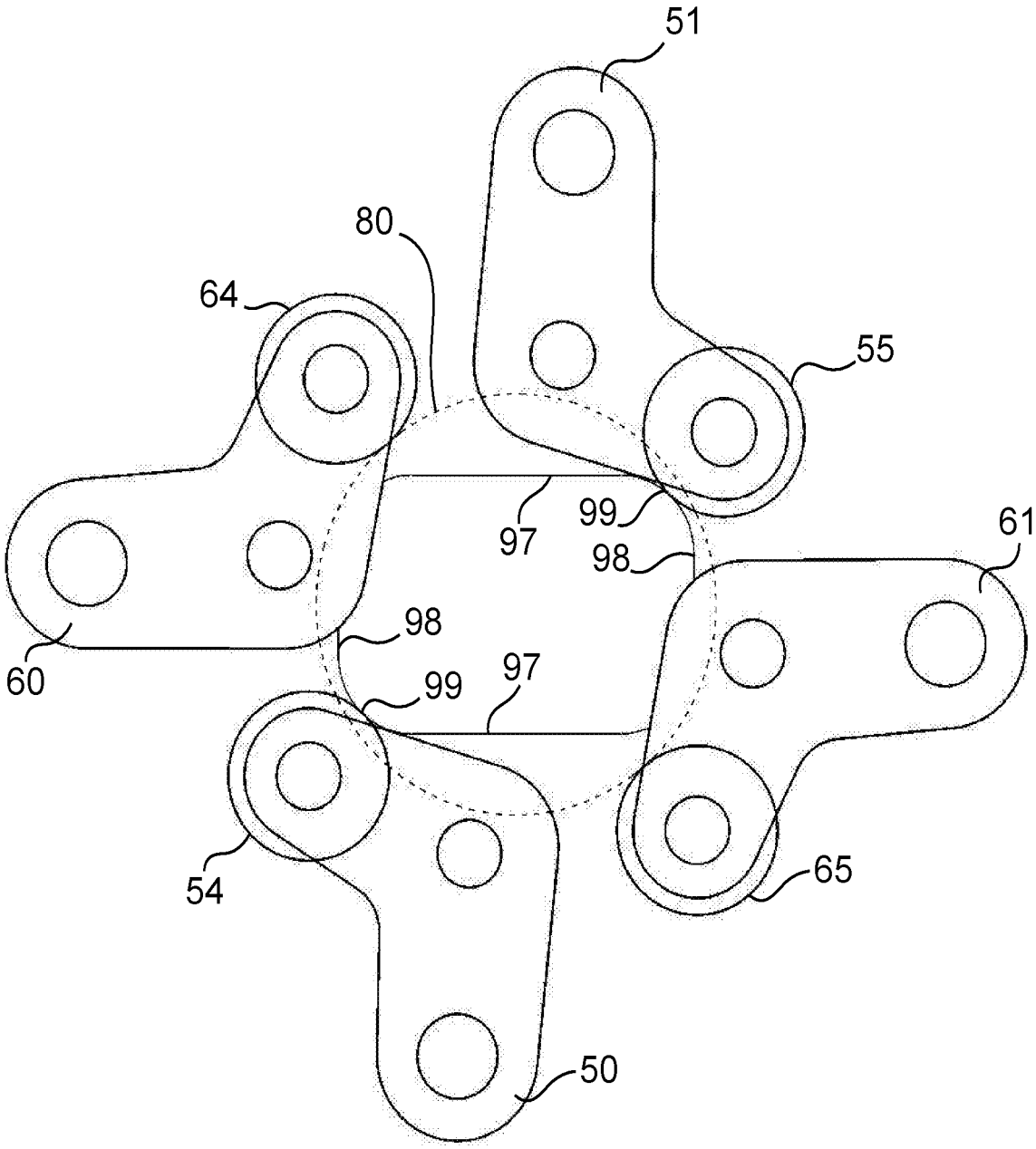
Figure 22:
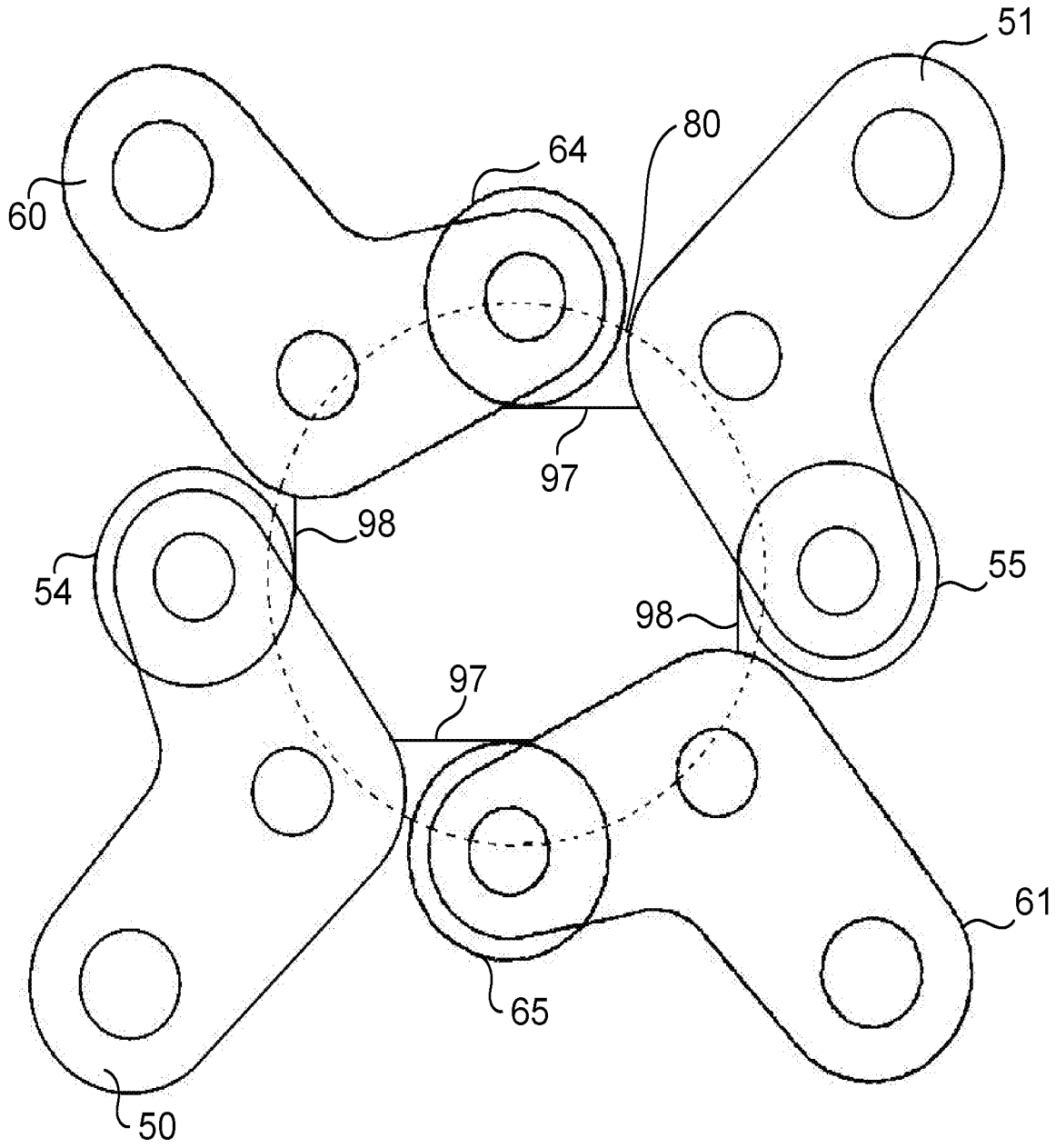
Figure 23:
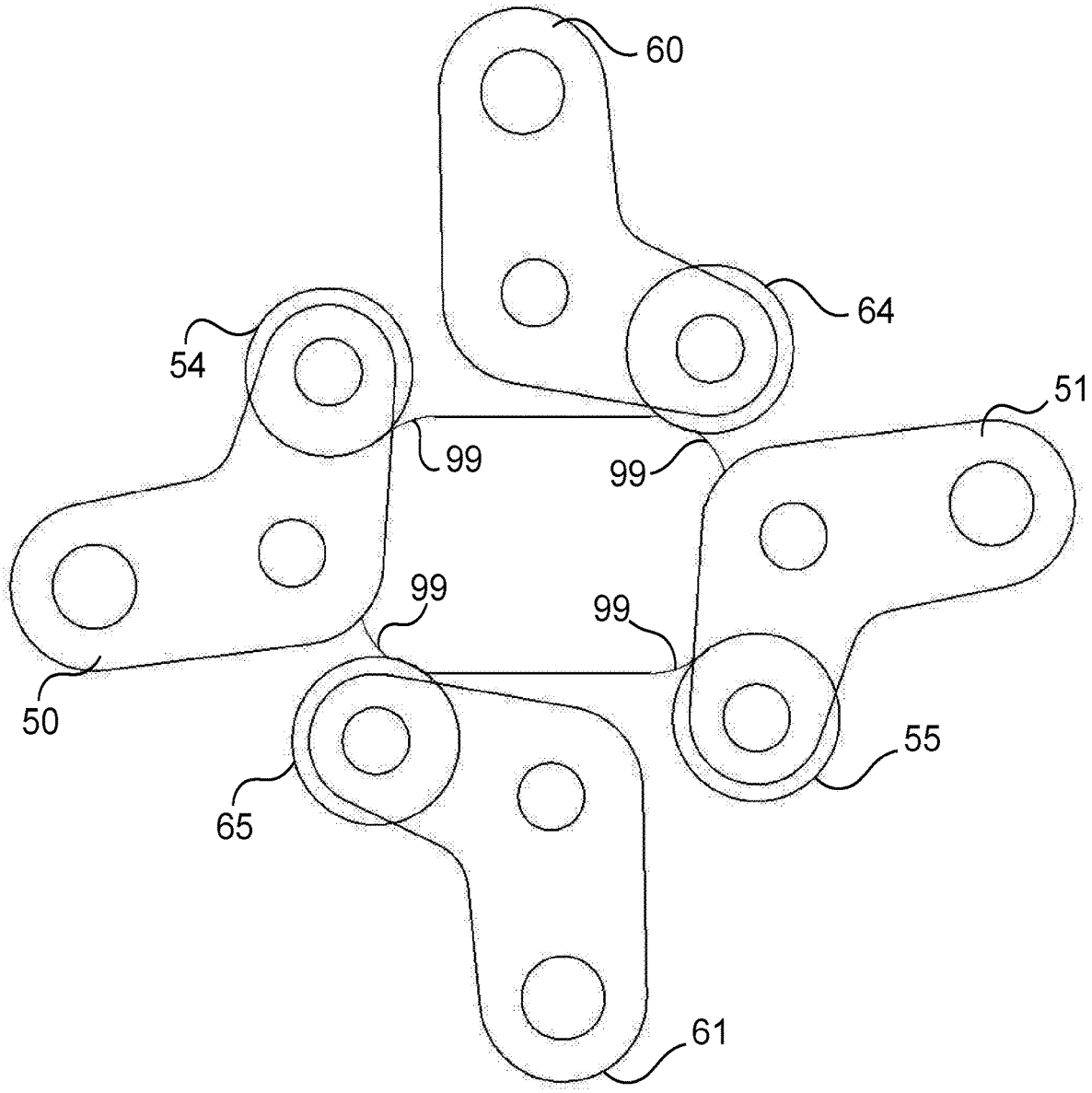
Figure 24:
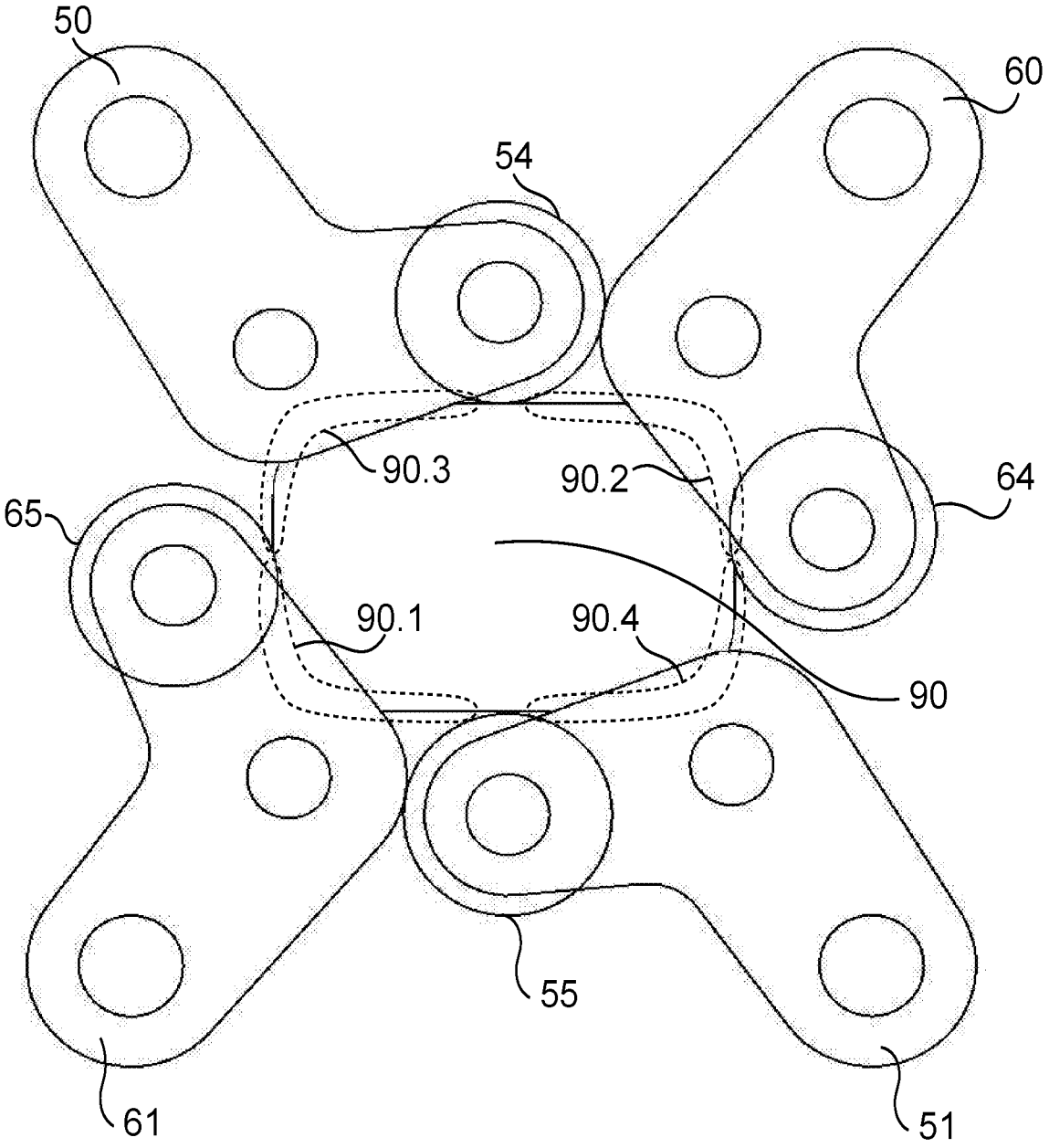

According to a fifth stage, the control unit 7 commands a positive angular offset $\varphi_1$ that moves the winding wheels 54 and 55 even closer to the Oy axis (FIG. 20). As the first, second and third plates 10, 20 and 30 rotate, the control unit 7 changes the value of the angular offset $\varphi_1$ so that the winding wheels 54 and 55 follow a second winding pass profile. During this stage, the winding wheels 54 and 55 follow the edges 97 of the can 90 (FIG. 20) and subsequently the fillets 99 (FIG. 21) before following the edges 98 (FIG. 22). When the winding wheels 54 and 55 arrive respectively on the middles of the edges 98, the control unit 7 commands a positive angular offset $\varphi_2$ between the first plate 10 and the third plate 30, which causes the winding wheels 64 and 65, which come into contact with the edges 97 of the can 90, to move closer together (FIG. 23). These portions of the edges 97 have already undergone two winding passes and can be crushed. Hence, the crushing pass begins while the winding pass is not yet completed. The crushing wheels 64 and 65 subsequently crush the edges 97 and the fillets 99 of the can 90 while the winding wheels 64 and 65 complete the second winding pass of the edges 98 and of the last fillets 99 (FIG. 24). The second winding pass is completed when the winding wheel 54 has reached the position occupied by the winding wheel 55 at the beginning of the fifth stage (FIG. 24). The periphery of the can 90 then has two portions marked 90.1 and 90.2 having a section shown in FIG. 6.*b* and two portions marked 90.3 and 90.4 having a section shown in FIG. 6.*c*. It should be noted that combined use of the winding wheels 54 and 55 makes it possible to carry out the second winding phase in a 180-degree rotation of the first plate 10 relative to the can 90. Winding of the edge to be crimped of the can 90 is thus carried out in two passes, which allows a more gradual deformation of the portions to be crimped, thereby reducing the defect rate of the final crimping.

Figure 25:
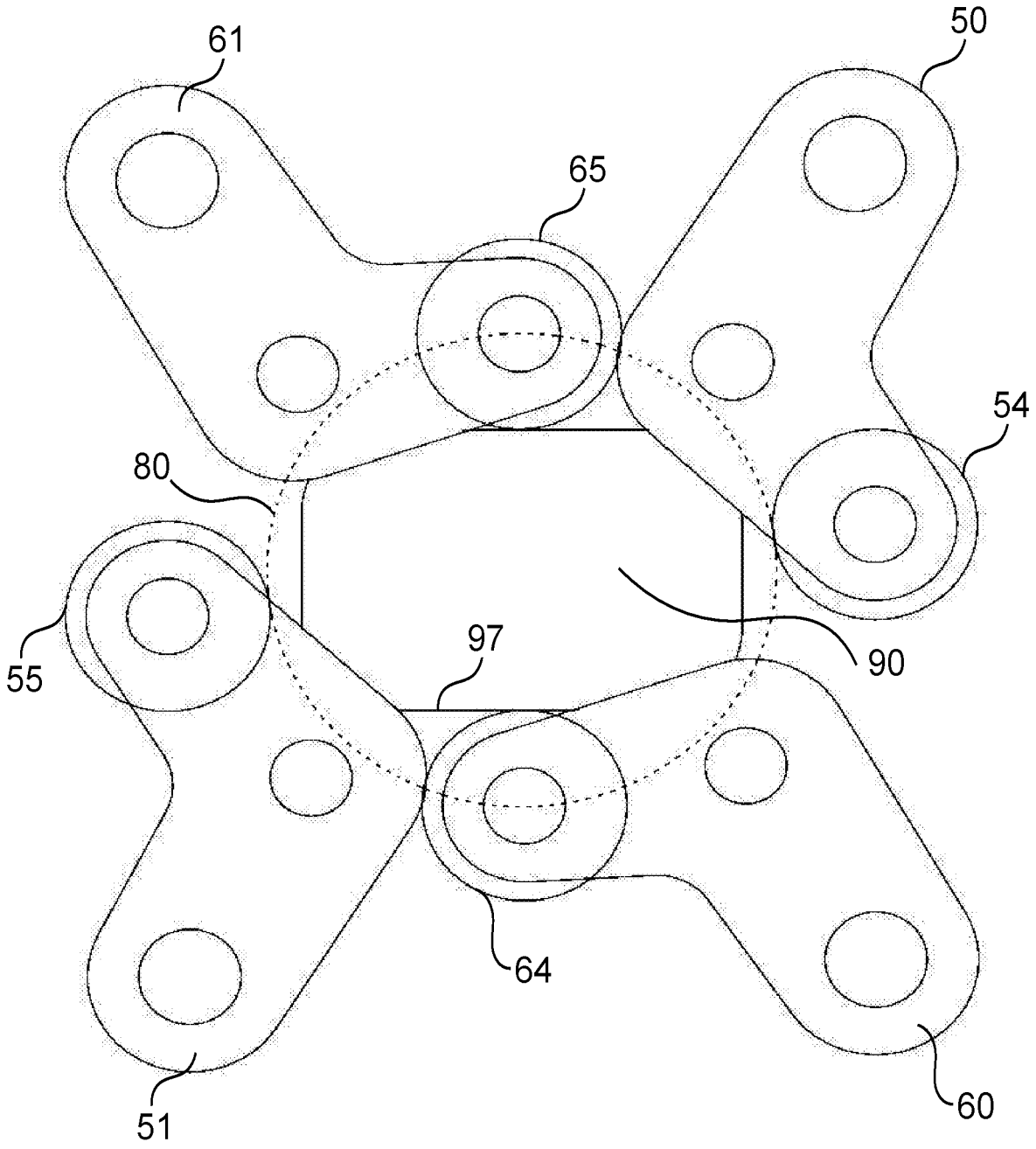

According to a sixth stage, the control unit 7 commands a negative angular offset $\varphi_1$ that moves the winding wheels 54 and 55 on the clearance profile 80 (FIG. 25). At the same time, the control unit 7 changes the value of the angular offset $\varphi_2$ as rotation of the first, second and third plates 10, 20 and 30 progresses, such that the crushing wheels 64 and 65 complete crushing of the edges 97 and of the fillets 99 of the can 90 (FIG. 25). The third winding pass is completed when the crushing wheel has reached the position occupied by the crushing wheel 65 at the beginning of the fifth stage (FIG. 25). The entire edge of the can 90 a then has a section illustrated in FIG. 6.*d*. It should be noted that combined use of the crushing wheels 64 and 65 makes it possible to carry out the third crushing phase in a 180-degree rotation of the first plate 10 and that it has been possible to accomplish this rotation partly simultaneously with the second crushing pass. The relative rotation of the plate 10 and of the can 90 for a complete crimping cycle is in this case 180° (first winding pass)+90° (first half of the second winding pass)+90° (second half of the second simultaneous winding pass to the first half of the crushing pass)+90°+90° (second half of the crushing pass), i.e. 270°. The invention therefore allows a reduction in the cycle times.

According to a final ejection phase, the control unit 7 commands deployment of the rod 8.1 of the electric jack 8, which subsequently protrudes from the orifice 43 of the mandrel 42 and ejects the can 90 and its crimped base 92. A rotation of the carousel 6 subsequently discharges the can 90 and brings a new assembly to be crimped directly above the mandrel 42. The crimping cycle can subsequently resume.

Crimping of the edge of the can 90 is obtained in this case, performed in one and a half turns of the crimping head, with the crimped edge being wound in two passes, thus guaranteeing a more gradual deformation of the edge to be crimped than in the machines of the prior art, thereby reducing the scrap rate.

Of course, the invention is not limited to the described embodiment but encompasses any alternative solution within the scope of the invention as defined in the claims.

Particularly,

Although the crimping unit in this case includes a mandrel, the invention also applies to other types of base support such as a roller moving along the first fold of the base opposite the winding and crushing wheels;

although the control unit in this case includes an electronic calculator, the invention also applies to other types of electronic control unit such as a control unit employing logic gates, a microprocessor, an FPGA or other;

although the legs of the crimping unit in this case are equipped with jacks to adjust the height of the frame, the invention also applies to other means of adjusting the height of the frame such as screws, racks and eccentrics placed at the level of the legs or on the uprights of the frame;

although the first, second and third plates in this case are mounted to rotate around a vertical axis, the invention also applies to other orientations of the axis of rotation of the plates such as a horizontal orientation or any other;

although the first, second and third plates in this case are rotationally driven by reduction servomotors, the invention also applies to other first, second and third means of rotationally driving the first, second and third plates, such as hydraulic or pneumatic motors;

although the crimping unit in this case comprises two levers carrying a winding wheel, the invention also applies to a crimping unit comprising a different number of levers carrying a winding wheel, such as a single lever or more than two levers carrying a winding wheel;

although the crimping unit in this case comprises two levers carrying a crushing wheel, the invention also applies to a crimping unit comprising a different number of levers carrying a crushing wheel, such as a single lever or more than two levers carrying a crushing wheel;

although the respective outer surfaces of the first and second shafts are in this case bronze-coated, the invention also applies to other types of arrangements allowing relative rotation of the first, second and third shafts, such as self-lubricating coatings, lubrication, bearings or no particular arrangements, the mutual relative rotation of the shafts being relatively small;

although the plates are in this case connected to the pinions by hollow shafts, the invention also applies to other types of rotating connections such as cages, rods or magnetic connections;

although the gears connected to each of the reduction servomotors are in this case located at different heights, the invention also applies to other solutions serving to avoid interference, such as hollow axial motors and belt or cable assemblies;

although in this case the crimping unit comprises an electric jack fixed to the end of the hollow shaft and connected to the control unit, the invention also applies to other means of ejection, such as a compressed air ejector or a rod moved by a cam. Activation of the ejector can also be controlled independently of the control unit;

although in this case a rotary carousel brings the can directly above the crimping head, the invention can also be combined with other means of feeding and discharging the can, such as a robotic arm or a belt conveyor;

although the pivots of the first, second, third and fourth levers are in this case all located on the same circle, the invention also applies to other configurations such as lever pivots positioned on circles of different diameters;

although the winding and crushing wheels are in this case positioned on the clearance profile for equal angular offset values $\varphi_1$ and $\varphi_2$, the invention also applies to different angular offset values $\varphi_1$ and $\varphi_2$ to position the winding and crushing wheels on the clearance profile;

although the shaped can has in this case a substantially rectangular cross-section, the invention also applies to crimping of other can shapes such as round-, square-, hexagonal- or polygonal-section cans the number of sides of which may be equal to three or more.

The invention claimed is:

1. A crimping unit for crimping a base on to a can body comprising:

a first plate mounted to rotate around a first axis on a frame and connected to first rotational driving means;

a first lever mounted to pivot on the first plate and equipped at a first end with a winding wheel;

a second lever mounted to pivot on the first plate and equipped at a first end with a crushing wheel;

wherein a winding actuator is connected to a second end of the first lever and a crushing actuator is connected to a second end of the second lever, with the winding actuator and the crushing actuator being governed by an electronic control unit in order to move the winding wheel and/or the crushing wheel so as to vary the distance between the winding wheel and/or the crushing wheel of the first axis according to the angular position of the first plate around the first axis; and wherein the winding actuator comprises a second plate mounted to rotate around the first axis and a second rotational driving means of the second plate, and wherein the crushing actuator comprises a third plate mounted to rotate around the first axis and third rotational driving means of the third plate.

2. The crimping unit according to claim 1, wherein:

the first rotational driving means of the first plate comprise a first reduction servomotor, a drive shaft of which is integral with a first pinion interacting with a first toothed wheel integral with the first plate;

the second rotational driving means of the second plate comprise a second reduction servomotor, a drive shaft of which is integral with a second pinion interacting with a second toothed wheel integral with the second plate;

the third rotational driving means of the third plate comprise a third reduction servomotor, a drive shaft of which is integral with a third pinion interacting with a third toothed wheel integral with the third plate.

3. The crimping unit according to claim 2, wherein the first rotational driving means comprise a first shaft connecting the first toothed wheel to the first plate and wherein the second and third rotational means respectively comprise a second hollow shaft and a third hollow shaft respectively connecting the second toothed wheel and the second plate, the third toothed wheel and the third plate and wherein the second hollow shaft extends around the first shaft and the third hollow shaft extends around the second hollow shaft.

4. The crimping unit according to claim 3, wherein the first shaft is a hollow shaft extending around a mandrel support shaft.

5. The crimping unit according to claim 4, wherein the mandrel support shaft comprises an ejector to separate the can from the mandrel after crimping.

6. The crimping unit according to claim 1, comprising:

a third lever mounted to pivot on the first plate and equipped at a first one end with a winding wheel;

a fourth lever mounted to pivot on the first plate and equipped at first end with a crushing wheel;

wherein the second end of the third lever is connected to the winding actuator and the second end of the fourth lever is connected to a crushing actuator.

7. The crimping unit according to claim 1, wherein the electronic control unit is configured such that each portion of a junction between the base and the can undergoes two passages of a winding wheel before undergoing at least one passage of a crushing wheel.

8. The crimping unit according to claim 1, comprising means of adjusting the height of the frame.

9. The crimping unit according to claim 1, comprising means of positioning the can in line with the mandrel.

10. The crimping unit according to claim 9, wherein the means of positioning the can comprise an electric jack.

* * * * *